US012006810B2

(12) United States Patent
Saponja

(10) Patent No.: US 12,006,810 B2
(45) Date of Patent: Jun. 11, 2024

(54) DOWNHOLE SEPARATOR

(71) Applicant: OILIFY NEW-TECH SOLUTIONS INC., Calgary (CA)

(72) Inventor: Jeffrey Charles Saponja, Invermere (CA)

(73) Assignee: OILIFY NEW-TECH SOLUTIONS INC., Calgary (CA)

( * ) Notice: Subject to any disclaimer, the term of this patent is extended or adjusted under 35 U.S.C. 154(b) by 0 days.

(21) Appl. No.: 18/087,791

(22) Filed: Dec. 22, 2022

(65) Prior Publication Data

US 2023/0193738 A1 Jun. 22, 2023

Related U.S. Application Data

(63) Continuation of application No. PCT/CA2021/050870, filed on Jun. 24, 2021.

(60) Provisional application No. 63/149,165, filed on Feb. 12, 2021, provisional application No. 63/043,506, filed on Jun. 24, 2020.

(51) Int. Cl.
*E21B 43/38* (2006.01)

(52) U.S. Cl.
CPC ..... *E21B 43/38* (2013.01)

(58) Field of Classification Search
CPC ..... E21B 43/38; E21B 43/35; E21B 43/385
See application file for complete search history.

(56) References Cited

U.S. PATENT DOCUMENTS

| | | | | |
|---|---|---|---|---|
| 1,697,321 | A * | 1/1929 | Marsh | E21B 43/38 166/105.1 |
| 2,549,706 | A | 4/1951 | Page | |
| 6,039,121 | A * | 3/2000 | Kisman | E21B 43/38 166/372 |
| 6,179,054 | B1 * | 1/2001 | Stewart | E21B 43/38 166/265 |
| 6,719,048 | B1 * | 4/2004 | Ramos | E21B 43/38 166/250.15 |
| 7,377,314 | B2 | 5/2008 | Gonzalez | |
| 9,022,106 | B1 * | 5/2015 | McCoy | E21B 43/38 166/105.5 |
| 9,765,608 | B2 | 9/2017 | Sims et al. | |
| 10,280,728 | B2 * | 5/2019 | Bommer | E21B 43/12 |
| 2004/0119588 | A1 * | 6/2004 | Marks | B60R 25/1004 340/539.1 |

(Continued)

FOREIGN PATENT DOCUMENTS

| | | |
|---|---|---|
| CA | 3050017 A1 | 7/2018 |
| CA | 3032720 A1 | 8/2019 |
| RU | 2269649 C2 | 2/2006 |

OTHER PUBLICATIONS

International Search Report and Written Opinion issued in International Application No. PCT/CA2021/050870, dated Aug. 27, 2021.

(Continued)

*Primary Examiner* — Blake Michener
(74) *Attorney, Agent, or Firm* — Smart & Biggar LP

(57) ABSTRACT

There is provided a system for producing hydrocarbon material from a subterranean formation. The system includes a gas separator for separating gaseous material from reservoir fluid obtained from the subterranean formation. The system is configured to mitigate interference to the separation.

33 Claims, 18 Drawing Sheets

(56) References Cited

U.S. PATENT DOCUMENTS

| | | | | |
|---|---|---|---|---|
| 2007/0119588 | A1* | 5/2007 | Gonzalez | E21B 43/38 166/268 |
| 2016/0333681 | A1* | 11/2016 | Mazzanti | E21B 43/38 |
| 2017/0044888 | A1* | 2/2017 | Bommer | F04D 29/708 |

OTHER PUBLICATIONS

International Preliminary Report on Patentability issued in International Application No. PCT/CA2021/050870, dated Dec. 13, 2022.

* cited by examiner

DOWNHOLE SEPARATOR

CROSS-REFERENCE TO RELATED APPLICATION

This application is a continuation of International Patent Application No. PCT/CA2021/050870 filed Jun. 24, 2021, titled DOWNHOLE SEPARATOR, which claims the benefits of priority to U.S. Provisional Patent Application No. 63/043,506, filed Jun. 24, 2020, titled DOWNHOLE SEPARATOR, and U.S. Provisional Patent Application No. 63/149,165, filed Feb. 12, 2021, titled DOWNHOLE SEPARATOR. The contents of International Patent Application No. PCT/CA2021/050870, U.S. Provisional Patent Application No. 63/043,506, and U.S. Provisional Patent Application No. 63/149,165 are hereby expressly incorporated into the present application by reference in their entirety.

FIELD

The present disclosure relates to mitigating downhole pump gas interference during hydrocarbon production.

BACKGROUND

Reservoir fluids often contain entrained gases and solids. In producing reservoir fluids containing a relatively substantial fraction of gaseous material, the presence of such gaseous material hinders production by contributing to sluggish flow, and interfering with pump operation. As well, the presence of solids interferes with pump operation, including contributing to erosion of mechanical components.

Separators are provided help remedy or mitigate downhole pump gas interference during hydrocarbon production. However, separators often occupy relatively significant amounts of space within a wellbore, rendering efficient separation of gaseous material that is entrained within the reservoir fluid difficult. Some separators are complex structures and are associated with increased material and manufacturing costs. Accordingly, efficient and cost effective separation of gaseous material that is entrained within the reservoir fluid is desirable.

SUMMARY

In one aspect there is a reservoir production system, emplaced within a wellbore string passage of a wellbore string that is lining a wellbore, for producing hydrocarbon material from a subterranean formation, comprising:

a gas separator;

a pump including a suction and a discharge; and a pressurized gas-depleted reservoir fluid conductor, fluidly coupled to the pump discharge, and extending to the surface;

wherein:

the gas separator is fluidly coupled to the pump suction, for supplying a gas-depleted reservoir fluid to the pump suction;

the pump is configured for pressurizing the supplied gas-depleted reservoir fluid;

the gas separator includes a flow diverter;

the gas separator and the wellbore string are co-operatively configured such that there is established, within the wellbore, a reservoir fluid-receiving zone, a reservoir fluid-conducting passage, a separation zone, and a liquid-depleted reservoir fluid-conducting passage;

the gas separator, the pump, the pressurized gas-depleted reservoir fluid conductor, and the wellbore string are further co-operatively configured such that:

while the reservoir fluid is flowing into the reservoir fluid-receiving zone from the subterranean formation, the reservoir fluid is conducted upwardly from the reservoir fluid-receiving zone such that the reservoir fluid becomes emplaced uphole relative to the flow diverter, and, upon emplacement uphole relative to the flow diverter, the reservoir fluid changes flow direction, such the reservoir fluid is flowing downwardly;

while the reservoir fluid is flowing downwardly, in response to at least buoyancy forces, the downwardly-flowing reservoir fluid becomes progressively depleted in gaseous material within the separation zone, with effect that: (i) a downwardly flow of the gaseous depleted reservoir fluid becomes emplaced within the flow diverter, and (ii) an upwardly flow of a liquid-depleted reservoir fluid is obtained and is conductible to the surface via the liquid-depleted reservoir fluid-conducting passage; and while the gas-depleted reservoir fluid flow is flowing downwardly within the flow diverter, the gas-depleted reservoir fluid flow is diverted by the flow diverter such the gas-depleted reservoir fluid flow is conducted upwardly to the pump, for pressurizing by the pump for flow to the surface via the pressurized gas-depleted reservoir fluid conductor;

the flow diverter defines a flow receiving communicator for receiving the downwardly flowing reservoir fluid, from which the downwardly flowing gaseous depleted reservoir fluid, emplaced within the flow diverter, is derived; and the ratio, of (ii) cross-sectional flow area of the wellbore string passage, to (ii) cross-sectional area of flow receiving communicator, is less than 1.1:1.

In another aspect there is a reservoir production system, emplaced within a wellbore string passage of a wellbore string that is lining a wellbore, for producing hydrocarbon material from a subterranean formation, comprising:

a gas separator;

a pump including a suction and a discharge; and a pressurized gas-depleted reservoir fluid conductor, fluidly coupled to the pump discharge, and extending to the surface;

wherein:

the gas separator is fluidly coupled to the pump suction, for supplying a gas-depleted reservoir fluid to the pump suction;

the pump is configured for pressurizing the supplied gas-depleted reservoir fluid;

the gas separator includes a flow diverter;

the gas separator and the wellbore string are co-operatively configured such that there is established, within the wellbore, a reservoir fluid-receiving zone, a reservoir fluid-conducting passage, a separation zone, and a liquid-depleted reservoir fluid-conducting passage;

the gas separator, the pump, the pressurized gas-depleted reservoir fluid conductor, and the wellbore string are further co-operatively configured such that:

while the reservoir fluid is flowing into the reservoir fluid-receiving zone from the subterranean formation, the reservoir fluid is conducted upwardly from the reservoir fluid-receiving zone such that the reservoir fluid becomes emplaced uphole relative to the flow diverter, and, upon emplacement uphole relative to the flow diverter, the reservoir fluid changes flow direction, such the reservoir fluid is flowing downwardly;

while the reservoir fluid is flowing downwardly, in response to at least buoyancy forces, the downwardly-flowing reservoir fluid becomes progressively depleted in gaseous material within the separation zone, with effect that: (i) a downwardly flow of the gaseous depleted reservoir fluid becomes emplaced within the flow diverter, and (ii) an upwardly flow of a liquid-depleted reservoir fluid is obtained and is conductible to the surface via the liquid-depleted reservoir fluid-conducting passage; and while the gas-depleted reservoir fluid flow is flowing downwardly within the flow diverter, the gas-depleted reservoir fluid flow is diverted by the flow diverter such the gas-depleted reservoir fluid is conducted upwardly to the pump, for pressurizing by the pump for flow to the surface via the pressurized gas-depleted reservoir fluid conductor;

and the pump-supplying fluid conductor includes an eccentrically-disposed portion, disposed eccentrically relative to a central longitudinal axis of the wellbore string passage, and at least a portion of the eccentrically-disposed portion is disposed adjacent to at least a portion of the separation zone.

In another aspect there is a reservoir production system, emplaced within a wellbore string passage of a wellbore string that is lining a wellbore, for producing hydrocarbon material from a subterranean formation, comprising:

a gas separator;

a pump including a suction and a discharge; and a pressurized gas-depleted reservoir fluid conductor, fluidly coupled to the pump discharge, and extending to the surface;

wherein:

the gas separator is fluidly coupled to the pump suction, for supplying a gas-depleted reservoir fluid to the pump suction;

the pump is configured for pressurizing the supplied gas-depleted reservoir fluid;

the gas separator includes a flow diverter;

the gas separator and the wellbore string are co-operatively configured such that there is established, within the wellbore, a reservoir fluid-receiving zone, a reservoir fluid-conducting passage, a separation zone, and a liquid-depleted reservoir fluid-conducting passage;

the gas separator, the pump, the pressurized gas-depleted reservoir fluid conductor, and the wellbore string are further co-operatively configured such that:

while the reservoir fluid is flowing into the reservoir fluid-receiving zone from the subterranean formation, the reservoir fluid is conducted upwardly from the reservoir fluid-receiving zone such that the reservoir fluid becomes emplaced uphole relative to the flow diverter, and, upon emplacement uphole relative to the flow diverter, the reservoir fluid changes flow direction, such the reservoir fluid is flowing downwardly;

while the reservoir fluid is flowing downwardly, in response to at least buoyancy forces, the downwardly-flowing reservoir fluid becomes progressively depleted in gaseous material within the separation zone, with effect that: (i) a downwardly flow of the gaseous depleted reservoir fluid becomes emplaced within the flow diverter, and (ii) an upwardly flow of a liquid-depleted reservoir fluid is obtained and is conductible to the surface via the liquid-depleted reservoir fluid-conducting passage; and while the gas-depleted reservoir fluid flow is flowing downwardly within the flow diverter, the gas-depleted reservoir fluid flow is diverted by the flow diverter such the gas-depleted reservoir fluid is conducted upwardly to the pump, for flow to the surface via the pressurized gas-depleted reservoir fluid conductor; and at least a portion of the pump-supplying fluid conductor defines a cross-sectional profile that is non-circular.

In another aspect there is a reservoir production system, emplaced within a wellbore string passage of a wellbore string that is lining a wellbore, for producing hydrocarbon material from a subterranean formation, comprising:

a gas separator;

a pump including a suction and a discharge; and a pressurized gas-depleted reservoir fluid conductor, fluidly coupled to the pump discharge, and extending to the surface;

wherein:

the gas separator is fluidly coupled to the pump suction, for supplying a gas-depleted reservoir fluid to the pump suction;

the pump is configured for pressurizing the supplied gas-depleted reservoir fluid;

the gas separator includes a flow diverter;

the gas separator and the wellbore string are co-operatively configured such that there is established, within the wellbore, a reservoir fluid-receiving zone, a reservoir fluid-conducting passage, a separation zone, and a liquid-depleted reservoir fluid-conducting passage;

the gas separator, the pump, the pressurized gas-depleted reservoir fluid conductor, and the wellbore string are further co-operatively configured such that:

while the reservoir fluid is flowing into the reservoir fluid-receiving zone from the subterranean formation, the reservoir fluid is conducted upwardly from the reservoir fluid-receiving zone such that the reservoir fluid becomes emplaced uphole relative to the flow diverter, and, upon emplacement uphole relative to the flow diverter, the reservoir fluid changes flow direction, such the reservoir fluid is flowing downwardly;

while the reservoir fluid is flowing downwardly, in response to at least buoyancy forces, the downwardly-flowing reservoir fluid becomes progressively depleted in gaseous material within the separation zone, with effect that: (i) a downwardly flow of the gaseous depleted reservoir fluid becomes emplaced within the flow diverter, and (ii) an upwardly flow of a liquid-depleted reservoir fluid is obtained and is conductible to the surface via the liquid-depleted reservoir fluid-conducting passage; and while the gas-depleted reservoir fluid flow is flowing downwardly within the flow diverter, the gas-depleted reservoir fluid flow is diverted by the flow diverter such the gas-depleted reservoir fluid is conducted upwardly to the pump, for pressurizing by the pump for flow to the surface via the pressurized gas-depleted reservoir fluid conductor;

the separation zone includes a cylindrical uninterrupted space;

and the wellbore string passage defines a cross-section, traversed by both of the cylindrical uninterrupted space and the pump-supplying fluid conductor, and the area of the cross-section of the wellbore string passage, occupied by the cylindrical uninterrupted space, defines at least 70% of the total cross-sectional area of the cross-section of the wellbore string passage.

In another aspect there is a reservoir production system, emplaced within a wellbore string passage of a wellbore string that is lining a wellbore, for producing hydrocarbon material from a subterranean formation, comprising:

a gas separator;

a pump including a suction and a discharge; and a pressurized gas-depleted reservoir fluid conductor, fluidly coupled to the pump discharge, and extending to the surface;

wherein:

the gas separator is fluidly coupled to the pump suction, for supplying a gas-depleted reservoir fluid to the pump suction;

the pump is configured for pressurizing the supplied gas-depleted reservoir fluid;

the gas separator includes a flow diverter;

the gas separator and the wellbore string are co-operatively configured such that there is established, within the wellbore, a reservoir fluid-receiving zone, a reservoir fluid-conducting passage, a separation zone, and a liquid-depleted reservoir fluid-conducting passage;

the gas separator, the pump, the pressurized gas-depleted reservoir fluid conductor, and the wellbore string are further co-operatively configured such that:

while the reservoir fluid is flowing into the reservoir fluid-receiving zone from the subterranean formation, the reservoir fluid is conducted upwardly from the reservoir fluid-receiving zone such that the reservoir fluid becomes emplaced uphole relative to the flow diverter, and, upon emplacement uphole relative to the flow diverter, the reservoir fluid changes flow direction, such the reservoir fluid is flowing downwardly;

while the reservoir fluid is flowing downwardly, in response to at least buoyancy forces, the downwardly-flowing reservoir fluid becomes progressively depleted in gaseous material within the separation zone, with effect that: (i) a downwardly flow of the gaseous depleted reservoir fluid becomes emplaced within the flow diverter, and (ii) an upwardly flow of a liquid-depleted reservoir fluid is obtained and is conductible to the surface via the liquid-depleted reservoir fluid-conducting passage; and while the gas-depleted reservoir fluid flow is flowing downwardly within the flow diverter, the gas-depleted reservoir fluid flow is diverted by the flow diverter such the gas-depleted reservoir fluid is conducted upwardly to the pump, for pressurizing by the pump for flow to the surface via the pressurized gas-depleted reservoir fluid conductor;

the separation zone includes a cylindrical uninterrupted space; and the cylindrical uninterrupted space has a diameter of at least one (1) inch and a height of at least 12 inches.

In another aspect there is a reservoir production system, emplaced within a wellbore string passage of a wellbore string that is lining a wellbore, for producing hydrocarbon material from a subterranean formation, comprising:

a gas separator;

a pump including a suction and a discharge; and a pressurized gas-depleted reservoir fluid conductor, fluidly coupled to the pump discharge, and extending to the surface;

wherein:

the gas separator is fluidly coupled to the pump suction, for supplying a gas-depleted reservoir fluid to the pump suction;

the pump is configured for pressurizing the supplied gas-depleted reservoir fluid;

the gas separator includes a flow diverter;

the gas separator and the wellbore string are co-operatively configured such that there is established, within the wellbore, a reservoir fluid-receiving zone, a reservoir fluid-conducting passage, a separation zone, and a liquid-depleted reservoir fluid-conducting passage;

the gas separator, the pump, the pressurized gas-depleted reservoir fluid conductor, and the wellbore string are further co-operatively configured such that:

while the reservoir fluid is flowing into the reservoir fluid-receiving zone from the subterranean formation, the reservoir fluid is conducted upwardly from the reservoir fluid-receiving zone such that the reservoir fluid becomes emplaced uphole relative to the flow diverter, and, upon emplacement uphole relative to the flow diverter, the reservoir fluid changes flow direction, such the reservoir fluid is flowing downwardly;

while the reservoir fluid is flowing downwardly, in response to at least buoyancy forces, the downwardly-flowing reservoir fluid becomes progressively depleted in gaseous material within the separation zone, with effect that: (i) a downwardly flow of the gaseous depleted reservoir fluid becomes emplaced within the flow diverter, and (ii) an upwardly flow of a liquid-depleted reservoir fluid is obtained and is conductible to the surface via the liquid-depleted reservoir fluid-conducting passage; and while the gas-depleted reservoir fluid flow is flowing downwardly within the flow diverter, the gas-depleted reservoir fluid flow is diverted by the flow diverter such the gas-depleted reservoir fluid is conducted upwardly to the pump, for pressurizing by the pump for flow to the surface via the pressurized gas-depleted reservoir fluid conductor;

and a central longitudinal axis of the wellbore string passage extends through the separation zone.

In another aspect there is a reservoir production system, emplaced within a wellbore string passage of a wellbore string that is lining a wellbore, for producing hydrocarbon material from a subterranean formation, comprising:

a gas separator;

a pump including a suction and a discharge; and a pressurized gas-depleted reservoir fluid conductor, fluidly coupled to the pump discharge, and extending to the surface;

wherein:

the gas separator is fluidly coupled to the pump suction, for supplying a gas-depleted reservoir fluid to the pump suction;

the pump is configured for pressurizing the supplied gas-depleted reservoir fluid;

the gas separator includes a flow diverter;

the gas separator and the wellbore string are co-operatively configured such that there is established, within the wellbore, a reservoir fluid-receiving zone, a reservoir fluid-conducting passage, a separation zone, and a liquid-depleted reservoir fluid-conducting passage;

the gas separator, the pump, the pressurized gas-depleted reservoir fluid conductor, and the wellbore string are further co-operatively configured such that:

while the reservoir fluid is flowing into the reservoir fluid-receiving zone from the subterranean formation, the reservoir fluid is conducted upwardly from the reservoir fluid-receiving zone such that the reservoir fluid becomes emplaced uphole relative to the flow diverter, and, upon emplacement uphole relative to the flow diverter, the reservoir fluid changes flow direction, such the reservoir fluid is flowing downwardly;

while the reservoir fluid is flowing downwardly, in response to at least buoyancy forces, the downwardly-flowing reservoir fluid becomes progressively depleted in gaseous material within the separation zone, with effect that: (i) a downwardly flow of the gaseous depleted reservoir fluid becomes emplaced within the flow diverter, and (ii) an upwardly flow of a liquid-depleted reservoir fluid is obtained and is conductible to the surface via the liquid-depleted reservoir fluid-conducting passage; and while the gas-depleted reservoir fluid flow is flowing downwardly within the flow diverter, the gas-depleted reservoir fluid flow is diverted by the flow diverter such the gas-depleted reservoir fluid is conducted upwardly to the pump, for pressurizing by the pump for flow to the surface via the pressurized gas-depleted reservoir fluid conductor;

and the flow diverter further includes:

a quiescent zone for encouraging separation of solids entrained within the gas-depleted reservoir fluid, prior to the conducting of the gas-depleted reservoir fluid to the pump;

a solids accumulation zone for receiving solids which have separated from the gas-depleted reservoir fluid within the quiescent zone; and a removable solids accumulation zone closure configured for opening such that communication with the solids accumulation zone is established externally of the flow diverter via a solids accumulation zone communicator.

In another aspect there is a reservoir production system, emplaced within a wellbore string passage of a wellbore string that is lining a wellbore, for producing hydrocarbon material from a subterranean formation, comprising:

a gas separator;

a pump including a suction and a discharge; and a pressurized gas-depleted reservoir fluid conductor, fluidly coupled to the pump discharge, and extending to the surface;

wherein:

the gas separator is fluidly coupled to the pump suction, for supplying a gas-depleted reservoir fluid to the pump suction;

the pump is configured for pressurizing the supplied gas-depleted reservoir fluid;

the gas separator includes a flow diverter;

the gas separator and the wellbore string are co-operatively configured such that there is established, within the wellbore, a reservoir fluid-receiving zone, a reservoir fluid-conducting passage, a separation zone, and a liquid-depleted reservoir fluid-conducting passage;

the gas separator, the pump, the pressurized gas-depleted reservoir fluid conductor, and the wellbore string are further co-operatively configured such that:

while the reservoir fluid is flowing into the reservoir fluid-receiving zone from the subterranean formation, the reservoir fluid is conducted upwardly from the reservoir fluid-receiving zone such that the reservoir fluid becomes emplaced uphole relative to the flow diverter, and, upon emplacement uphole relative to the flow diverter, the reservoir fluid changes flow direction, such the reservoir fluid is flowing downwardly;

while the reservoir fluid is flowing downwardly, in response to at least buoyancy forces, the downwardly-flowing reservoir fluid becomes progressively depleted in gaseous material within the separation zone, with effect that: (i) a downwardly flow of the gaseous depleted reservoir fluid becomes emplaced within the flow diverter, and (ii) an upwardly flow of a liquid-depleted reservoir fluid is obtained and is conductible to the surface via the liquid-depleted reservoir fluid-conducting passage; and while the gas-depleted reservoir fluid flow is flowing downwardly within the flow diverter, the gas-depleted reservoir fluid flow is diverted by the flow diverter such the gas-depleted reservoir fluid is conducted upwardly to the pump, for pressurizing by the pump for flow to the surface via the pressurized gas-depleted reservoir fluid conductor;

and the flow diverter further includes:

a quiescent zone for encouraging separation of solids entrained within the gas-depleted reservoir fluid, prior to the conducting of the gas-depleted reservoir fluid to the pump;

a solids collector for collecting the solids separated from the gas-depleted reservoir fluid within the quiescent zone; and a solids collector receiving counterpart, releasably coupled to the solids collector, such that the solids collector is removable from the flow diverter.

In another aspect there is a reservoir production system, emplaced within a wellbore string passage of a wellbore string that is lining a wellbore, for producing hydrocarbon material from a subterranean formation, comprising:

a gas separator;

a pump including a suction and a discharge; and a pressurized gas-depleted reservoir fluid conductor, fluidly coupled to the pump discharge, and extending to the surface;

wherein:

the gas separator is fluidly coupled to the pump suction, for supplying a gas-depleted reservoir fluid to the pump suction;

the pump is configured for pressurizing the supplied gas-depleted reservoir fluid;

the gas separator includes a flow diverter;

the flow diverter includes a pump-supplying fluid conductor, connected to the pump suction, such that the fluid coupling of the gas separator to the pump suction is effected via the pump-supplying fluid conductor;

the gas separator and the wellbore string are co-operatively configured such that there is established, within the wellbore, a reservoir fluid-receiving zone, a reservoir fluid-conducting passage, a separation zone, and a liquid-depleted reservoir fluid-conducting passage;

the gas separator, the pump, the pressurized gas-depleted reservoir fluid conductor, and the wellbore string are further co-operatively configured such that:

while the reservoir fluid is flowing into the reservoir fluid-receiving zone from the subterranean formation, the reservoir fluid is conducted upwardly from the reservoir fluid-receiving zone such that the reservoir fluid becomes emplaced uphole relative to the flow diverter, and, upon emplacement uphole relative to the flow diverter, the reservoir fluid changes flow direction, such the reservoir fluid is flowing downwardly;

while the reservoir fluid is flowing downwardly, in response to at least buoyancy forces, the downwardly-flowing reservoir fluid becomes progressively depleted in gaseous material within the separation zone, with effect that: (i) a downwardly flow of the gaseous depleted reservoir fluid becomes emplaced within the flow diverter, and (ii) an upwardly flow of a liquid-depleted reservoir fluid is obtained and is conductible to the surface via the liquid-depleted reservoir fluid-conducting passage; and while the gas-depleted reservoir fluid flow is flowing downwardly within the flow diverter, the gas-depleted reservoir fluid flow is diverted by the flow diverter such the gas-depleted reservoir fluid is conducted upwardly to the pump, via the pump-supplying fluid conductor, for pressurizing by the pump for flow to the surface via the pressurized gas-depleted reservoir fluid conductor;

the pump-supplying fluid conductor includes a pump-supplying fluid conductor flow receiver for receiving the gas-depleted reservoir fluid;

the flow diverter defines:

a flow receiving communicator for receiving the downwardly flowing reservoir fluid, from which the downwardly flowing gaseous depleted reservoir fluid, emplaced within the flow diverter, is derived; and a quiescent zone for encouraging separation of solids entrained within the gas-depleted reservoir fluid;

and includes:

a quiescent zone fluid conductor, disposed in flow communication with the flow receiving communicator, for conducting at least a fraction of the downwardly flowing reservoir fluid such that the at least a fraction of the downwardly flowing reservoir fluid becomes emplaced within the quiescent zone and below the pump-supplying fluid conductor flow receiver, prior to the conducting of the gas-depleted reservoir fluid to the pump-supplying fluid conductor flow receiver.

In another aspect there is a reservoir production system, emplaced within a wellbore string passage of a wellbore string that is lining a wellbore, for producing hydrocarbon material from a subterranean formation, comprising:

a gas separator;

a pump including a suction and a discharge; and a pressurized gas-depleted reservoir fluid conductor, fluidly coupled to the pump discharge, and extending to the surface;

wherein:

the gas separator is fluidly coupled to the pump suction, for supplying a gas-depleted reservoir fluid to the pump suction;

the pump is configured for pressurizing the supplied gas-depleted reservoir fluid;

the gas separator includes a flow diverter;

the flow diverter includes a pump-supplying fluid conductor, connected to the pump suction, such that the fluid coupling of the gas separator to the pump suction is effected via the pump-supplying fluid conductor;

the gas separator and the wellbore string are co-operatively configured such that there is established, within the wellbore, a reservoir fluid-receiving zone, a reservoir fluid-conducting passage, a separation zone, and a liquid-depleted reservoir fluid-conducting passage;

the gas separator, the pump, the pressurized gas-depleted reservoir fluid conductor, and the wellbore string are further co-operatively configured such that:

while the reservoir fluid is flowing into the reservoir fluid-receiving zone from the subterranean formation, the reservoir fluid is conducted upwardly from the reservoir fluid-receiving zone such that the reservoir fluid becomes emplaced uphole relative to the flow diverter, and, upon emplacement uphole relative to the flow diverter, the reservoir fluid changes flow direction, such the reservoir fluid is flowing downwardly;

while the reservoir fluid is flowing downwardly, in response to at least buoyancy forces, the downwardly-flowing reservoir fluid becomes progressively depleted in gaseous material within the separation zone, with effect that: (i) a downwardly flow of the gaseous depleted reservoir fluid becomes emplaced within the flow diverter, and (ii) an upwardly flow of a liquid-depleted reservoir fluid is obtained and is conductible to the surface via the liquid-depleted reservoir fluid-conducting passage; and while the gas-depleted reservoir fluid flow is flowing downwardly within the flow diverter, the gas-depleted reservoir fluid flow is diverted by the flow diverter such the gas-depleted reservoir fluid is conducted upwardly to the pump, via the pump-supplying fluid conductor, for pressurizing by the pump for flow to the surface via the pressurized gas-depleted reservoir fluid conductor;

the pump-supplying fluid conductor includes a pump-supplying fluid conductor flow receiver for receiving the gas-depleted reservoir fluid;

the flow diverter defines:

a flow receiving communicator for receiving the downwardly flowing reservoir fluid, from which the downwardly flowing gaseous depleted reservoir fluid, emplaced within the flow diverter, is derived; and a quiescent zone for encouraging separation of solids entrained within the gas-depleted reservoir fluid;

and includes:

an uphole quiescent zone fluid conductor, disposed in flow communication with the flow receiving communicator, wherein the uphole quiescent zone flow conductor includes a flow receiver for receiving the downwardly flowing reservoir fluid, and defines a contoured surface configured to induce torsional flow in the received downwardly flowing reservoir fluid, with effect that the downwardly flowing reservoir fluid separates into a solids-lean reservoir fluid flow and a solids-rich reservoir fluid flow, wherein, relative to the solids-lean reservoir fluid flow, the solids-rich reservoir fluid flow is disposed further outwardly from the central longitudinal axis of the quiescent zone flow conductor;

a solids-lean reservoir fluid flow-conducting conductor, defining a solids-lean reservoir fluid flow-discharging communicator; and a solids-rich reservoir fluid flow-conducting conductor, defining a solids-rich reservoir fluid flow-discharging communicator;

the uphole quiescent zone fluid conductor, the solids-lean reservoir fluid flow-conducting conductor, and the solids-rich reservoir fluid flow-conducting conductor are co-operatively configured such that:

the solids-lean reservoir fluid flow-conducting conductor is positioned, relative to the uphole quiescent zone fluid conductor, for receiving the solids-lean reservoir fluid flow and conducting the solids-lean reservoir fluid flow to the solids-lean reservoir fluid flow-discharging communicator for discharging into the quiescent zone, and the solids-rich reservoir fluid flow-conducting conductor is positioned, relative to the uphole quiescent zone fluid conductor, for receiving the solids-rich reservoir fluid flow and conducting the solids-rich reservoir fluid flow to the solids-rich reservoir fluid flow-discharging communicator for discharging into the quiescent zone;

and the solids-lean reservoir fluid flow-discharging communicator is disposed above the solids-rich reservoir fluid-flow discharging communicator.

In another aspect there is a reservoir production system, emplaced within a wellbore string passage of a wellbore string that is lining a wellbore, for producing hydrocarbon material from a subterranean formation, comprising:

a gas separator;

a pump including a suction and a discharge; and a pressurized gas-depleted reservoir fluid conductor, fluidly coupled to the pump discharge, and extending to the surface;

wherein:

the gas separator is fluidly coupled to the pump suction, for supplying a gas-depleted reservoir fluid to the pump suction;

the pump is configured for pressurizing the supplied gas-depleted reservoir fluid;

the gas separator includes a flow diverter;

the flow diverter includes a pump-supplying fluid conductor, connected to the pump suction, such that the fluid coupling of the gas separator to the pump suction is effected via the pump-supplying fluid conductor;

the gas separator and the wellbore string are co-operatively configured such that there is established, within the wellbore, a reservoir fluid-receiving zone, a reservoir fluid-conducting passage, a separation zone, and a liquid-depleted reservoir fluid-conducting passage;

the gas separator, the pump, the pressurized gas-depleted reservoir fluid conductor, and the wellbore string are further co-operatively configured such that:

while the reservoir fluid is flowing into the reservoir fluid-receiving zone from the subterranean formation, the reservoir fluid is conducted upwardly from the reservoir fluid-receiving zone such that the reservoir fluid becomes emplaced uphole relative to the flow diverter, and, upon emplacement uphole relative to the flow diverter, the reservoir fluid changes flow direction, such the reservoir fluid is flowing downwardly;

while the reservoir fluid is flowing downwardly, in response to at least buoyancy forces, the downwardly-flowing reservoir fluid becomes progressively depleted in gaseous material within the separation zone, with effect that: (i) a downwardly flow of the gaseous depleted reservoir fluid becomes emplaced within the flow diverter, and (ii) an upwardly flow of a liquid-depleted reservoir fluid is obtained and is conductible to the surface via the liquid-depleted reservoir fluid-conducting passage; and while the gas-depleted reservoir fluid flow is flowing downwardly within the flow diverter, the gas-depleted reservoir fluid flow is diverted by the flow diverter such the gas-depleted reservoir fluid is conducted upwardly to the pump, via the pump-supplying fluid conductor, for pressurizing by the pump for flow to the surface via the pressurized gas-depleted reservoir fluid conductor;

the pump-supplying fluid conductor includes a pump-supplying fluid conductor flow receiver for receiving the gas-depleted reservoir fluid;

the flow diverter defines:

a flow receiving communicator for receiving the downwardly flowing reservoir fluid, from which the downwardly flowing gaseous depleted reservoir fluid, emplaced within the flow diverter, is derived; and a quiescent zone for encouraging separation of solids entrained within the gas-depleted reservoir fluid;

and includes:

a quiescent zone fluid conductor, disposed in flow communication with the flow receiving communicator, for conducting at least a fraction of the downwardly flowing reservoir fluid, and including a quiescent zone flow discharging communicator for discharging the at least a fraction of the downwardly flowing reservoir fluid into the quiescent zone, prior to the conducting of the at least a fraction of the downwardly flowing reservoir fluid to the pump-supplying fluid conductor flow receiver;

and the distance of the closest flowpath, between the quiescent zone flow discharging communicator and the pump-supplying fluid conductor flow receiver, is greater than two (2) inches.

In another aspect there is a reservoir production system, emplaced within a wellbore string passage of a wellbore string that is lining a wellbore, for producing hydrocarbon material from a subterranean formation, comprising:

a gas separator;

a pump including a suction and a discharge; and a pressurized gas-depleted reservoir fluid conductor, fluidly coupled to the pump discharge, and extending to the surface;

wherein:

the gas separator is fluidly coupled to the pump suction, for supplying a gas-depleted reservoir fluid to the pump suction;

the pump is configured for pressurizing the supplied gas-depleted reservoir fluid;

the gas separator includes a flow diverter;

the flow diverter includes a pump-supplying fluid conductor, connected to the pump suction, such that the fluid coupling of the gas separator to the pump suction is effected via the pump-supplying fluid conductor;

the gas separator and the wellbore string are co-operatively configured such that there is established, within the wellbore, a reservoir fluid-receiving zone, a reservoir fluid-conducting passage, a separation zone, and a liquid-depleted reservoir fluid-conducting passage;

the gas separator, the pump, the pressurized gas-depleted reservoir fluid conductor, and the wellbore string are further co-operatively configured such that:

while the reservoir fluid is flowing into the reservoir fluid-receiving zone from the subterranean formation, the reservoir fluid is conducted upwardly from the reservoir fluid-receiving zone such that the reservoir fluid becomes emplaced uphole relative to the flow diverter, and, upon emplacement uphole relative to the flow diverter, the reservoir fluid changes flow direction, such the reservoir fluid is flowing downwardly;

while the reservoir fluid is flowing downwardly, in response to at least buoyancy forces, the downwardly-flowing reservoir fluid becomes progressively depleted in gaseous material within the separation zone, with effect that: (i) a downwardly flow of the gaseous depleted reservoir fluid becomes emplaced within the flow diverter, and (ii) an upwardly flow of a liquid-depleted reservoir fluid is obtained and is conductible to the surface via the liquid-depleted reservoir fluid-conducting passage; and while the gas-depleted reservoir fluid flow is flowing downwardly within the flow diverter, the gas-depleted reservoir fluid flow is diverted by the flow diverter such the gas-depleted reservoir fluid is conducted upwardly to the pump, via the pump-supplying fluid conductor, for pressurizing by the pump for flow to the surface via the pressurized gas-depleted reservoir fluid conductor;

the pump-supplying fluid conductor includes a pump-supplying fluid conductor flow receiver for receiving the gas-depleted reservoir fluid;

the flow diverter defines:

a flow receiving communicator for receiving the downwardly flowing reservoir fluid, from which the downwardly flowing gaseous depleted reservoir fluid, emplaced within the flow diverter, is derived; and a quiescent zone for encouraging separation of solids entrained within the gas-depleted reservoir fluid;

and includes:

a baffle; and a quiescent zone fluid conductor, disposed in flow communication with the flow receiving communicator, for conducting at least a fraction of the downwardly flowing reservoir fluid such that the at least a fraction of the downwardly flowing reservoir fluid becomes emplaced within the quiescent zone, prior to the conducting of the gas-depleted reservoir fluid to the pump-supplying fluid conductor flow receiver;

wherein:

the baffle directs the downwardly flowing reservoir flow towards the quiescent zone flow conductor.

In another aspect there is a reservoir production system, emplaced within a wellbore string passage of a wellbore string that is lining a wellbore, for producing hydrocarbon material from a subterranean formation, comprising:

a gas separator;

a pump including a suction and a discharge; and a pressurized gas-depleted reservoir fluid conductor, fluidly coupled to the pump discharge, and extending to the surface;

wherein:

the gas separator is fluidly coupled to the pump suction, for supplying a gas-depleted reservoir fluid to the pump suction;

the pump is configured for pressurizing the supplied gas-depleted reservoir fluid;

the gas separator includes a flow diverter;

the flow diverter includes a pump-supplying fluid conductor, connected to the pump suction, such that the fluid coupling of the gas separator to the pump suction is effected via the pump-supplying fluid conductor;

the gas separator and the wellbore string are co-operatively configured such that there is established, within the wellbore, a reservoir fluid-receiving zone, a reservoir fluid-conducting passage, a separation zone, and a liquid-depleted reservoir fluid-conducting passage;

the gas separator, the pump, the pressurized gas-depleted reservoir fluid conductor, and the wellbore string are further co-operatively configured such that:

while the reservoir fluid is flowing into the reservoir fluid-receiving zone from the subterranean formation, the reservoir fluid is conducted upwardly from the reservoir fluid-receiving zone such that the reservoir fluid becomes emplaced uphole relative to the flow diverter, and, upon emplacement uphole relative to the flow diverter, the reservoir fluid changes flow direction, such the reservoir fluid is flowing downwardly;

while the reservoir fluid is flowing downwardly, in response to at least buoyancy forces, the downwardly-flowing reservoir fluid becomes progressively depleted in gaseous material within the separation zone, with effect that: (i) a downwardly flow of the gaseous depleted reservoir fluid becomes emplaced within the flow diverter, and (ii) an upwardly flow of a liquid-depleted reservoir fluid is obtained and is conductible to the surface via the liquid-depleted reservoir fluid-conducting passage; and while the gas-depleted reservoir fluid flow is flowing downwardly within the flow diverter, the gas-depleted reservoir fluid flow is diverted by the flow diverter such the gas-depleted reservoir fluid is conducted upwardly to the pump, via the pump-supplying fluid conductor, for pressurizing by the pump for flow to the surface via the pressurized gas-depleted reservoir fluid conductor;

the flow diverter defines:

a flow diverter-defined fluid conductor for effecting the diverting of the gas-depleted reservoir fluid; and a shroud that separates the flow diverter-defined fluid conductor from the intermediate passage; and the shroud is supported by the elongated support member connected to the pump-supplying fluid conductor.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1:
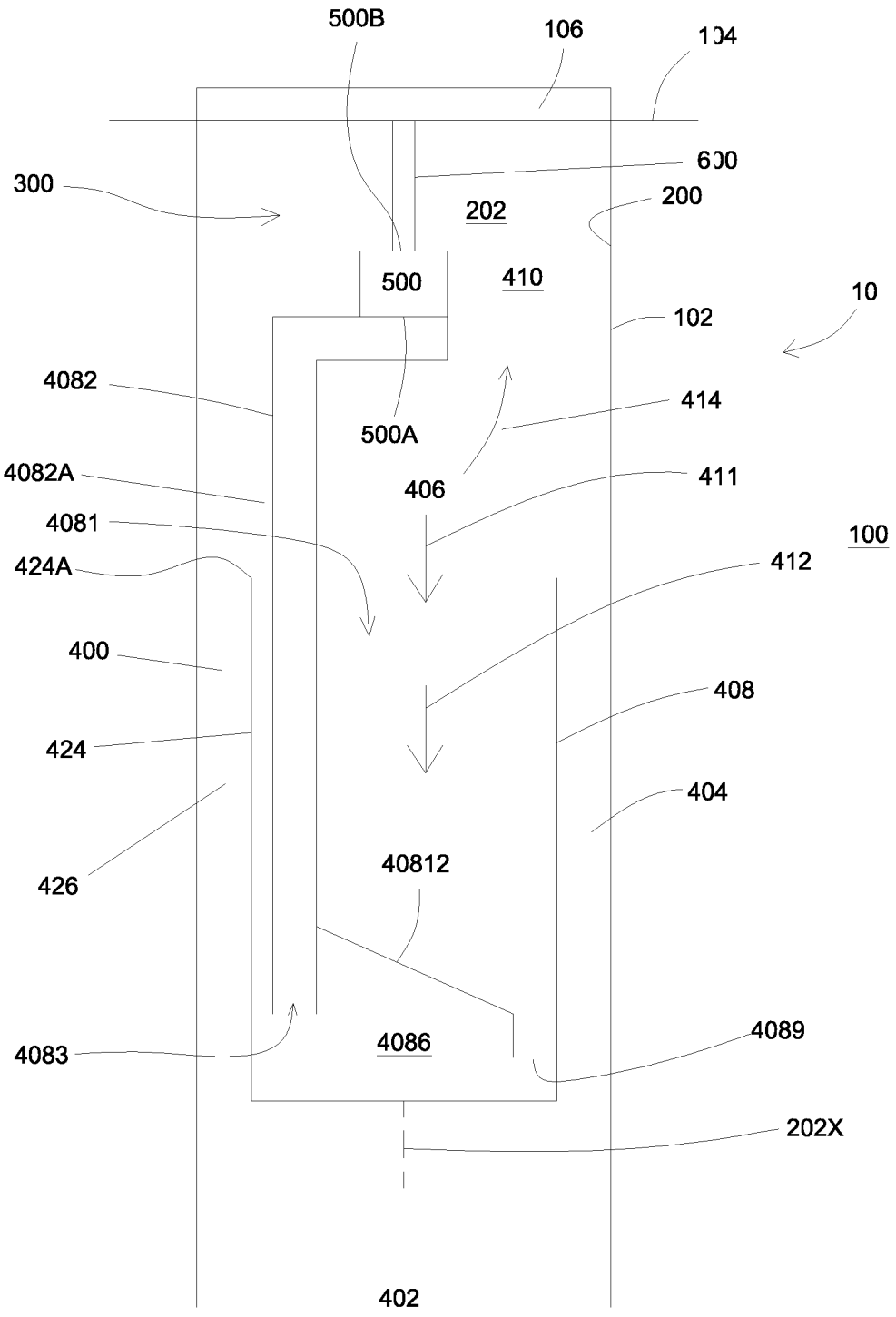
FIG. 1 is a schematic illustration of an embodiment of a reservoir production system, of the present disclosure, disposed within a wellbore.

Referring to FIGS. 1, there is provided a system 10 for producing hydrocarbon material from an oil reservoir within a subterranean formation 100.

A wellbore 102 of a subterranean formation can be straight, curved or branched. The wellbore can have various wellbore sections. A wellbore section is an axial length of a wellbore 102. A wellbore section can be characterized as "vertical" or "horizontal" even though the actual axial orientation can vary from true vertical or true horizontal, and even though the axial path can tend to "corkscrew" or otherwise vary. In some embodiments, for example, the central longitudinal axis of the passage of a horizontal section is disposed along an axis that is between about 70 and about 110 degrees relative to the vertical, while the central longitudinal axis of the passage of a vertical section is disposed along an axis that is less than about 20 degrees from the vertical "V", and a transition section is disposed between the horizontal and vertical sections.

"Reservoir fluid" is fluid that is contained within an oil reservoir. Reservoir fluid can be liquid material, gaseous material, or a mixture of liquid material and gaseous material. The reservoir fluid includes hydrocarbon material, such as oil, natural gas condensates, or any combination thereof. The reservoir fluid can also contain water. The reservoir fluid can also include fluids injected into the reservoir for effecting stimulation of resident fluids within the reservoir.

A wellbore string 200 is emplaced within the wellbore 102 for stabilizing the subterranean formation 100. In some embodiments, for example, the wellbore string 200 also contributes to effecting fluidic isolation of one zone within the subterranean formation 100 from another zone within the subterranean formation 100.

The fluid productive portion of the wellbore 102 may be completed either as a cased-hole completion or an open-hole completion.

With respect to a cased-hole completion, in some embodiments, for example, a wellbore string 200, in the form of a wellbore casing that includes one or more casing strings, each of which is positioned within the wellbore 102, having one end extending from the wellhead 106, is provided. In some embodiments, for example, each casing string is defined by jointed segments of pipe. The jointed segments of pipe typically have threaded connections.

Typically, a wellbore 102 contains multiple intervals of concentric casing strings, successively deployed within the previously run casing. With the exception of a liner string, casing strings typically run back up to the surface 104. Typically, casing string sizes are intentionally minimized to minimize costs during well construction. Generally, smaller casing sizes make production and artificial lifting more challenging.

For wells that are used for producing reservoir fluid, few of these actually produce through the wellbore casing. This is because producing fluids can corrode steel or form undesirable deposits (for example, scales, asphaltenes or paraffin waxes) and the larger diameter can make flow unstable. In this respect, a production string is usually installed inside the last casing string. The production string is provided to conduct reservoir fluid, received within the wellbore, to the wellhead 106. In some embodiments, for example, the annular region between the last casing string and the production tubing string may be sealed at the bottom by a packer.

The wellbore 102 is disposed in flow communication (such as through perforations provided within the installed casing or liner, or by virtue of the open hole configuration of the completion), or is selectively disposable into flow communication (such as by perforating the installed casing, or by actuating a valve to effect opening of a port), with the subterranean formation 100. When disposed in flow communication with the subterranean formation 100, the wellbore 102 is disposed for receiving reservoir fluid flow from the subterranean formation 100, with effect that the system 10 receives the reservoir fluid.

In some embodiments, for example, the wellbore casing is set short of total depth. Hanging off from the bottom of the wellbore casing, with a liner hanger or packer, is a liner string. The liner string can be made from the same material as the casing string, but, unlike the casing string, the liner string does not extend back to the wellhead 106. Cement may be provided within the annular region between the liner string and the oil reservoir for effecting zonal isolation (see below), but is not in all cases. In some embodiments, for example, this liner is perforated to effect flow communication between the reservoir and the wellbore. In some embodiments, for example, the production tubing string may be engaged or stung into the liner string, thereby providing a fluid passage for conducting the produced reservoir fluid to the wellhead 106.

An open-hole completion is established by drilling down to the producing formation, and then lining the wellbore (such as, for example, with a wellbore string 200). The wellbore is then drilled through the producing formation, and the bottom of the wellbore is left open (i.e. uncased), to effect flow communication between the reservoir and the wellbore.

The system 10 receives, via the wellbore 102, the reservoir fluid flow from the subterranean formation 100. As discussed above, the wellbore 102 is disposed in flow communication (such as through perforations provided within the installed casing or liner, or by virtue of the open hole configuration of the completion), or is selectively manipulated into flow communication (such as by perforating the installed casing, or by actuating a valve to effect opening of a port), with the subterranean formation 100. When disposed in flow communication with the subterranean formation 100, the wellbore 102 is disposed for receiving reservoir fluid flow from the subterranean formation 100, with effect that the system 10 receives the reservoir fluid.

In some embodiments, for example, the system 10 includes a production system 300 emplaced within a wellbore string passage 202 of the wellbore string 200. The production system 300 includes a gas separator 400, a pump 500, and a pressurized gas-depleted reservoir fluid conductor 600. The pump 500 includes a suction 500A and a discharge 500B. The pressurized gas-depleted reservoir fluid conductor 600 is connected to the pump 500, such that the pressurized gas-depleted reservoir fluid conductor 600 is fluidly coupled to the pump discharge 500B.

The production system 300 is configured for producing reservoir fluid while, amongst other things, mitigating gas lock within the pump 500. In this respect, the gas-separator 400 effects separation of gaseous material from reservoir fluid received from the subterranean formation 100, with effect that a gas-depleted reservoir fluid is obtained, supplied to the suction 500A of the pump 500, pressurized by the pump 500, with effect that the pressurized gas-depleted reservoir fluid is discharged via the pump discharge 500B and received by the pressurized gas-depleted reservoir fluid conductor 600, for flow to the surface via the pressurized gas-depleted reservoir fluid conductor 600. In parallel, the separated gaseous material is recoverable as a liquid-depleted reservoir fluid, conducted upwardly to the surface 104 via a liquid-depleted reservoir fluid-conducting passage 410 within the wellbore. The reservoir fluid produced from the subterranean formation 100, via the wellbore 102, including the gas-depleted reservoir fluid, the liquid-depleted reservoir fluid, or both, may be discharged through the wellhead 106 to a collection facility, such as a storage tank within a battery.

The wellbore string 200 and the gas separator 400 are co-operatively configured such that there is established, within the wellbore 102, a reservoir fluid-receiving zone 402, a separation zone 406, and the liquid-depleted reservoir fluid-conducting passage 410. In some embodiments, for example, the separation zone 406 is disposed within a vertical portion of the wellbore 102. The separation zone 406 is disposed vertically above (and uphole relative to) the reservoir fluid-receiving zone 402, and vertically below (and downhole relative to) the wellhead 106. The liquid-depleted reservoir fluid-conducting passage 410 is disposed vertically above the separation zone 406 and extends to the surface 104.

The reservoir fluid-receiving zone 402 is disposed for receiving reservoir fluid flow that is conducted from the subterranean formation 100 and into the wellbore 102. In this respect, reservoir fluid flow, from the subterranean formation 100, becomes emplaced within the reservoir fluid-receiving zone 402. In some embodiments, for example, the reservoir fluid-receiving zone 402 is disposed within a horizontal section of the wellbore 102.

Gaseous material is separated from the received reservoir fluid within the separation zone 406, with effect that a downwardly-flowing gas-depleted reservoir fluid is obtained.

The gas separator 400 includes a flow diverter 408 for diverting the downwardly flowing gas-depleted reservoir fluid, obtained from the separation zone 406, such that the downwardly flowing gas-depleted reservoir fluid changes flow direction, with effect that the gas-depleted reservoir fluid is flowing upwardly for supply to the pump 500. In some embodiments, for example, the flow diverter 408 defines a gas-depleted reservoir fluid-conducting passage 407, and the gas-depleted reservoir fluid-conducting passage 407 extends from the separation zone 406 to the pump 500, for supplying the pump 500 with gas-depleted reservoir fluid.

Figure 2:
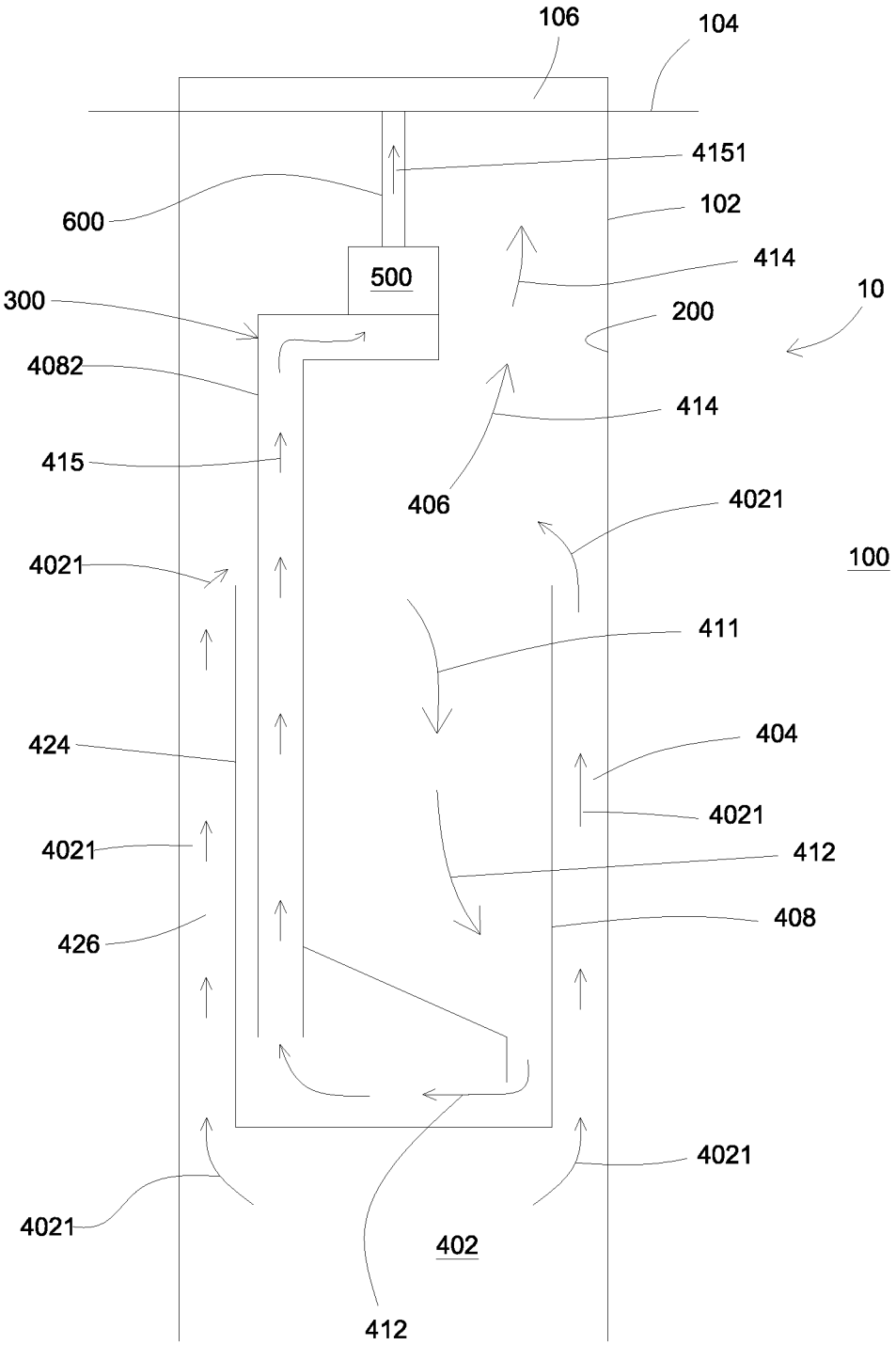
FIG. 2 is identical to the embodiment illustrated in FIG. 1, and illustrating fluid flows established during operation.

Referring to FIGS. 1 and 2, the gas separator 400, the pump 500, the gas-depleted reservoir fluid conductor 600, and the wellbore string 200 are further co-operatively configured such that:

while the reservoir fluid is flowing into the reservoir fluid-receiving zone 402 from the subterranean formation 100, the reservoir fluid flow 4021 is conducted upwardly from the reservoir fluid-receiving zone 402 such that the reservoir fluid flow becomes emplaced uphole relative to the flow diverter 408, and, upon emplacement uphole relative to the flow diverter 408, the reservoir fluid flow changes direction, such that the reservoir fluid is flowing downwardly (flow 411);

while the reservoir fluid is flowing downwardly, in response to at least buoyancy forces, the downwardly-flowing reservoir fluid becomes progressively depleted in gaseous material within the separation zone 406, with effect that: (i) a downwardly flow (flow 412) of the gas-depleted reservoir fluid becomes emplaced within the flow diverter 408, and (ii) an upwardly flow (flow 414) of the liquid-depleted reservoir fluid is obtained and is conductible to the surface via the liquid-depleted reservoir fluid-conducting passage 410; and while the gas-depleted reservoir fluid flow is flowing downwardly within the flow diverter 408, the gas-depleted reservoir fluid flow is diverted by the flow diverter 408, such that the gas-depleted reservoir fluid is conducted upwardly to the pump 500, for pressurizing by the pump 500 for flow as flow 4151 to the surface via the pressurized gas-depleted reservoir fluid conductor 600.

In some embodiments, for example, the wellbore string 200 and the gas separator 400 are further co-operatively configured such that a reservoir fluid-conducting passage 426 is established, and the conducting of the reservoir fluid flow in an upwardly direction from the reservoir fluid-receiving zone 402, with effect that the reservoir fluid flow becomes emplaced uphole relative to the flow diverter 408, is effected by the reservoir fluid-conducting passage 426.

In some embodiments, for example, the emplacement of the production system 300 within the wellbore string 202 is with effect that an intermediate passage 426 is defined between the flow diverter 408 and the wellbore string 202. In some embodiments, for example, the intermediate passage 426 defines at least a portion of the reservoir fluid-conducting passage 404.

Figure 3:
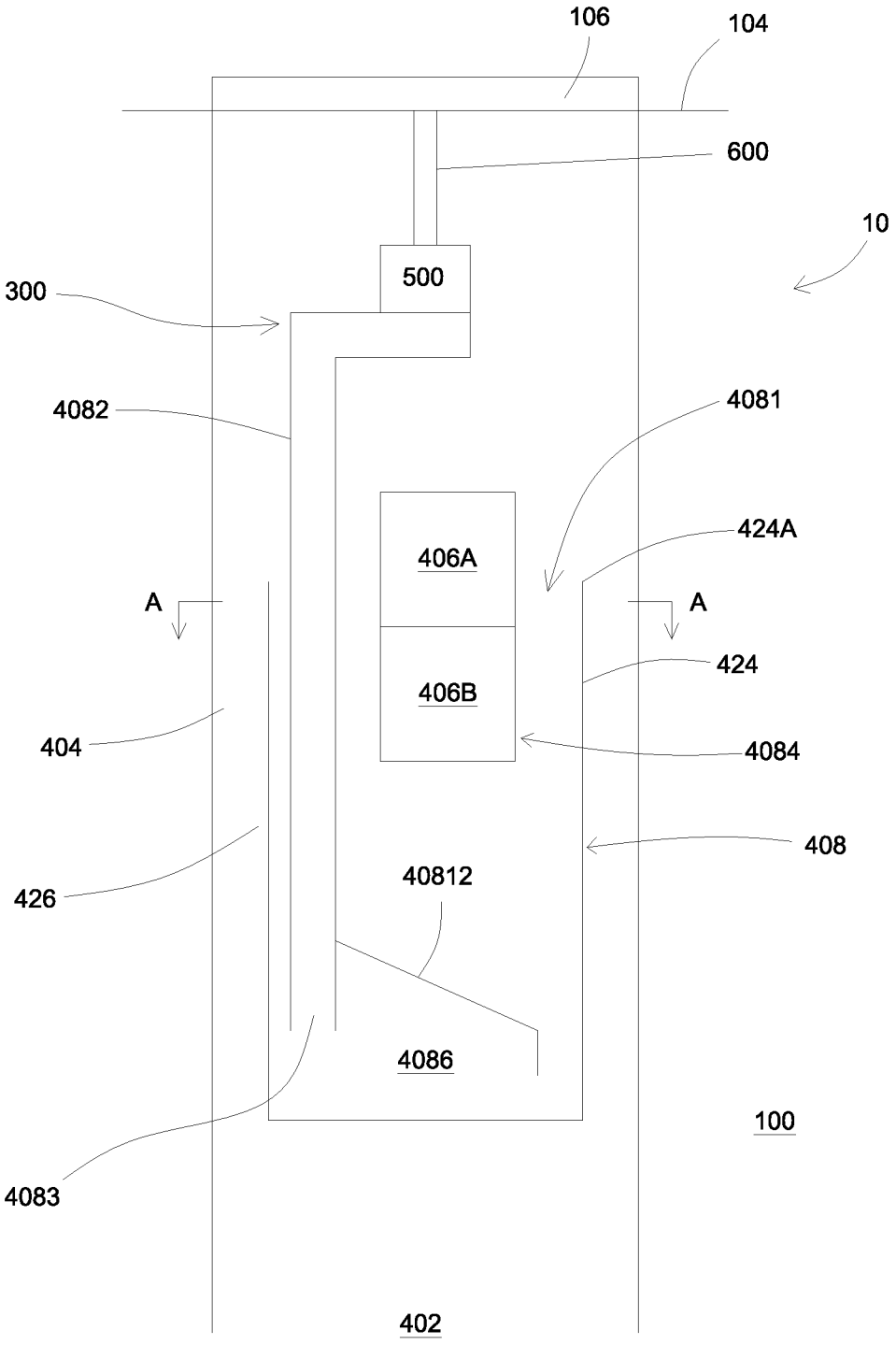
FIG. 3 is identical to the embodiment illustrated in FIG. 1, and illustrating establishment of a separation zone with portions within and above the flow diverter.
Figure 4:
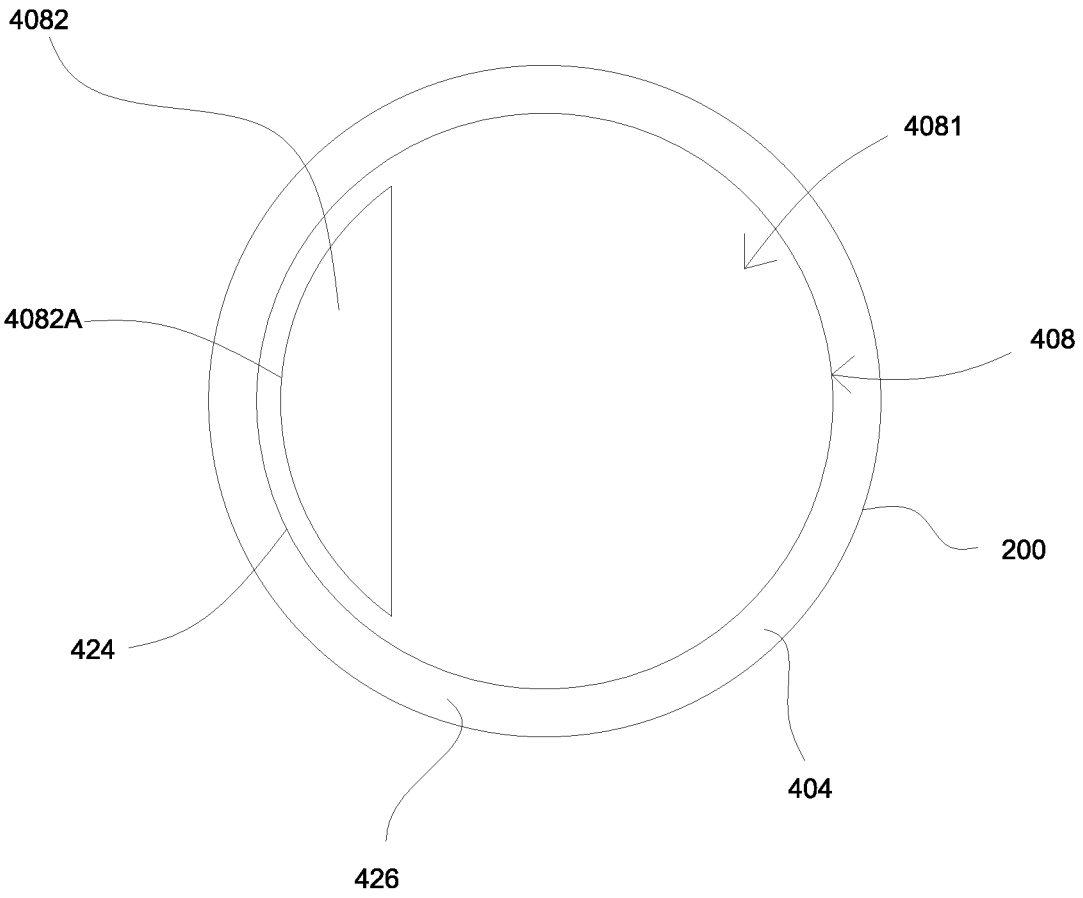
FIG. 4 is a schematic illustration of a sectional view of the embodiment illustrated in FIG. 3, taken along lines A-A in FIG. 3.

Referring to FIGS. 3 and 4, in some embodiments, for example, the flow diverter 408 defines a flow receiving communicator 4081 (e.g. an aperture) for receiving a downwardly-flowing reservoir fluid, from which the downwardly flowing gaseous depleted reservoir fluid, emplaced within the flow diverter 408, is derived. In some embodiments, for example, the flow receiving communicator 4081, of the flow diverter 408, has a cross-sectional flow area of at least six (6) inches squared. In some embodiments, for example, the ratio, of (ii) cross-sectional flow area of the wellbore string passage 202, to (ii) cross-sectional area of flow receiving communicator 4081, is less than 1.1:1.

In some embodiments, for example, the flow diverter 408 is disposed below (and downhole relative to) at least a portion of the separation zone 406. In some of these embodiments, for example, at least a portion of the separation zone 406 is disposed within a space 4084, defined within the flow diverter 408, and, in this respect, in such embodiments, the at least a portion of the separation zone 406, disposed within the space 4084, defines a separation zone space 406A. Also with respect to those embodiments where the flow diverter 408 is disposed below (and downhole relative to) at least a portion of the separation zone 406, in some of embodiments, for example, at least a portion of the separation zone 406 is disposed uphole relative to the flow diverter 408, and the portion of the separation zone 406 disposed uphole relative to the flow diverter 406 defines a separation zone space 406B.

Referring to FIG. 3, in some embodiments, for example, the separation zone 406 is defined by the separation zone space 406A and the separation zone space 406B. In this respect, in some embodiments, for example, the separation zone 406 is disposed within, as well as uphole relative to, the flow diverter 408, such that the reservoir fluid, conducted from the reservoir fluid-receiving zone 402, becomes partially depleted in gaseous material, in response to at least buoyancy forces, within the separation zone space 406B, and becomes further depleted in gaseous material, in response to at least buoyancy forces, within the separation zone space 406A.

Figure 6:
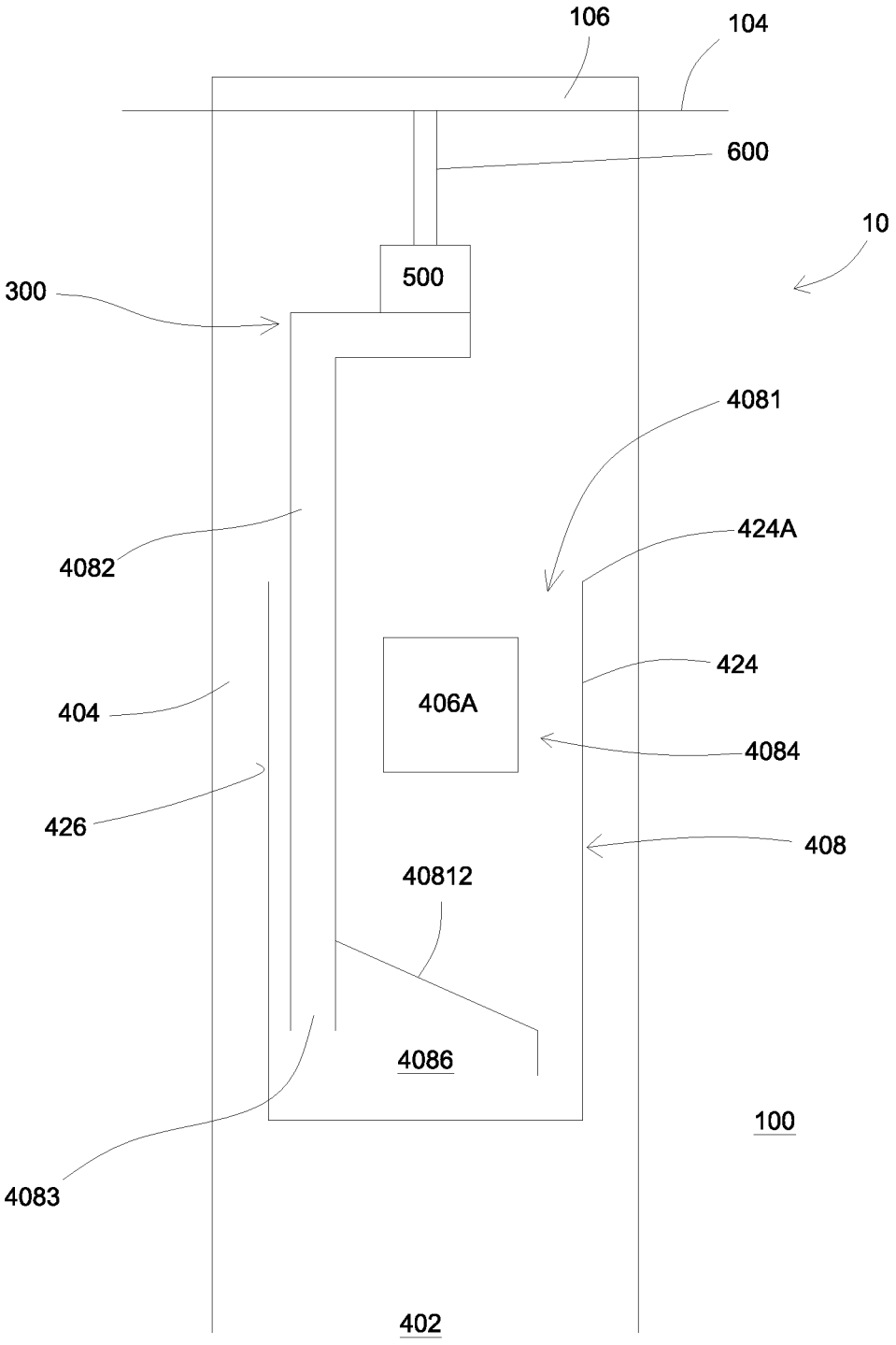
FIG. 6 is identical to the embodiment illustrated in FIG. 1, and illustrating establishment of a separation zone within the flow diverter.

Referring to FIG. 6, in some embodiments, for example, the entirety of the separation zone 406 is disposed above the flow diverter 408, such that the separation zone 406 is defined by the separation zone space 406B, and the entirety of the depletion of gaseous material from the downwardly-flowing reservoir fluid, in response to at least buoyancy forces, occurs uphole relative to the flow receiving communicator 4081. In this respect, the downwardly-flowing reservoir fluid, being received by the flow receiving communicator 4081, is the gas-depleted reservoir fluid.

Figure 5:
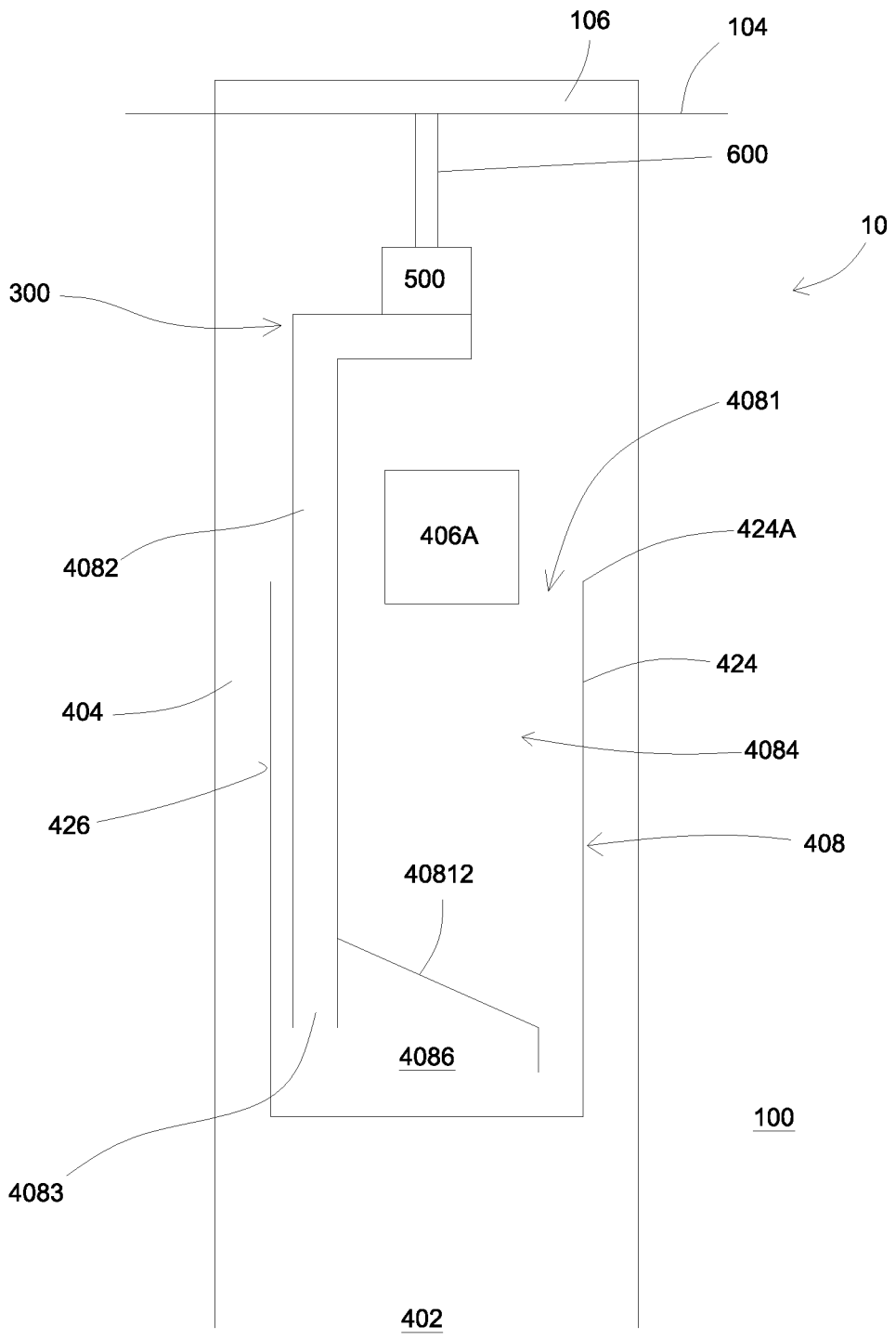
FIG. 5 is identical to the embodiment illustrated in FIG. 1, and illustrating establishment of a separation zone above the flow diverter.

Referring to FIG. 5, in some embodiments, for example, the entirety of the separation zone 406 is disposed within the flow diverter 408, such that the separation zone 406 is defined by the separation zone space 406A, and the entirety of the depletion of gaseous material from the downwardly-flowing reservoir fluid, in response to at least buoyancy forces, occurs within the flow diverter 408. In this respect, the downwardly-flowing reservoir fluid, being received by the flow receiving communicator 4081, is the reservoir fluid from which there has been an absence of any depletion of gaseous material.

Referring to FIGS. 1 and 2, in some embodiments, for example, the flow diverter 408 includes a collector 4090, and the collector 4090 defines a collection space 4092. The reservoir fluid collector 4090 defines a shroud 424, which separates the collection space 4092 from the intermediate passage 426. The upper edge 424A of the shroud 424 defines the flow receiving communicator 4081.

The collector 4090 also includes a pump-supplying fluid conductor 4082, connected to the pump suction 500A, such that the fluid coupling of the gas separator to the pump suction 500A is effected via the pump-supplying fluid conductor. In this respect, the pump-supplying fluid conductor 4082 is fluidly coupled to the suction 500A of the pump 500, for conducting the separated gas-depleted reservoir fluid from the flow diverter 408 to the pump 500 as a flow 415. The pump-supplying fluid conductor 4082 defines a flow receiver 4083 (e.g. an inlet), which effects flow communication between the pump-supplying fluid conductor 4082 and the collector 4090.

In this respect, the reservoir fluid-receiving zone 402 is disposed in flow communication with the suction 500A of the pump 500 via the collector 4090 and the pump supplying fluid conductor 4082. Also in this respect, the diverting of the gas-depleted reservoir fluid, flowing in the downwardly direction, with effect that there is a change in direction of the gas-depleted reservoir fluid flow, such that the gas-depleted reservoir fluid is conducted upwardly to the suction 500A of the pump 500, is effected by co-operation between the collector 4090 and the pump supplying fluid conductor 408. Even further in this respect, the co-operation between the collector 4090 and the pump supplying fluid conductor 408 defines the gas-depleted reservoir fluid-conducting passage 407.

In some embodiments, for example, the ratio of the cross-sectional flow area of the flow diverter flow receiving communicator 4081 to the maximum cross-sectional flow area of the pump-supplying fluid conductor 4082 is at least 1:0.127.

In some embodiments, for example, the pump-supplying fluid conductor 4082 is co-operatively disposed relative to the separation zone 406 such that interference with the separation, within the separation zone 406, of the reservoir fluid into the gas-depleted reservoir fluid and the liquid-depleted reservoir fluid, by the pump-supplying fluid conductor 4082 (such as, for example, resistance, provided by the pump-supplying fluid conductor 4082, to the upward movement of gaseous bubbles within the separation zone 406), is mitigated.

Figure 7:
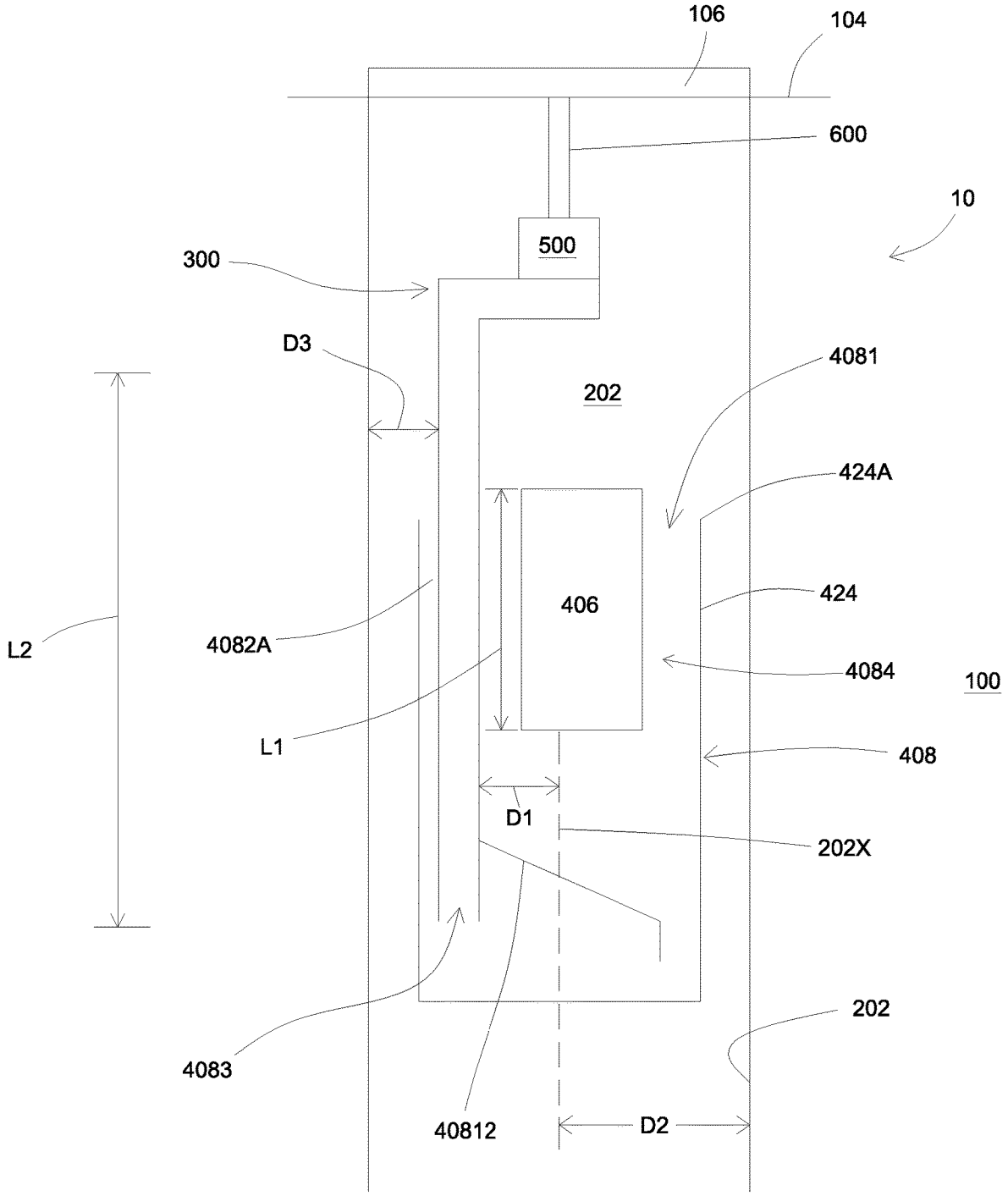
FIG. 7 is identical to the embodiment illustrated in FIG. 1, and identifying features relating to the positioning of the pump supplying fluid conductor relative to the separation zone.

Referring to FIG. 7, to mitigate such interference, in some embodiments, for example, the pump-supplying fluid conductor 4082 includes an eccentrically-disposed portion 4082A, and at least a portion of the eccentrically-disposed portion 4082A is disposed adjacent to at least a portion of the separation zone 406. In some embodiments, for example, the entirety of the separation zone 406 is disposed adjacent to the eccentrically-disposed portion 4082A.

In some embodiments, for example, the at least a portion of the separation zone 406, disposed adjacent to the eccentrically-disposed portion 4082A, has a total length "L1" of at least six (6) inches, as measured along an axis that is parallel to the central longitudinal axis 202X of the wellbore string passage 202.

In some embodiments, for example, the eccentrically-disposed portion 4082A has a total length "L2" of at least six (6) feet, as measured along the central longitudinal axis 4082AX of the eccentrically-disposed portion 4082A. In some embodiments, for example, the eccentrically-disposed portion 4082A has a total length of at least 15 feet, as measured along the central longitudinal axis 4082AX of the eccentrically-disposed portion 4082A.

The eccentrically-disposed portion 4082A is disposed eccentrically relative to the central longitudinal axis 202X of the wellbore string passage 202. In some embodiments, for example, the ratio of (i) the minimum distance "D1" between the eccentrically-disposed portion 4082A and the central longitudinal axis 202X of the wellbore string passage 202 to (ii) the minimum distance "D2" between the wellbore string 200 and the central longitudinal axis 202X of the wellbore string passage 202 is greater than 1.2:1. In some embodiments, for example, the eccentrically-disposed portion 4082A is spaced-apart from the wellbore string 200 by a maximum distance "D3" of less than 0.75 inches, such as, for example, less than 0.5 inches, such as, for example, less than 0.25 inches.

Referring to FIG. 4, in some embodiments, for example, the eccentrically-disposed portion 4082A has a cross-sectional profile that is non-circular (e.g. oval-shaped). Configuring the eccentrically-disposed portion 4082A, such that its cross-sectional profile is non-circular, further mitigates interference with the separation, within the separation zone 406, of the reservoir fluid into the gas-depleted reservoir fluid and the liquid-depleted reservoir fluid, by the upwardly-conducting conductor 4082, and this is more pronounced where the cross-sectional profile of the eccentrically-disposed portion 4082A is oval-shaped and the cross-sectional profile of the wellbore string section, traversed by the eccentrically-disposed portion 4082A, is circular.

Figure 8:
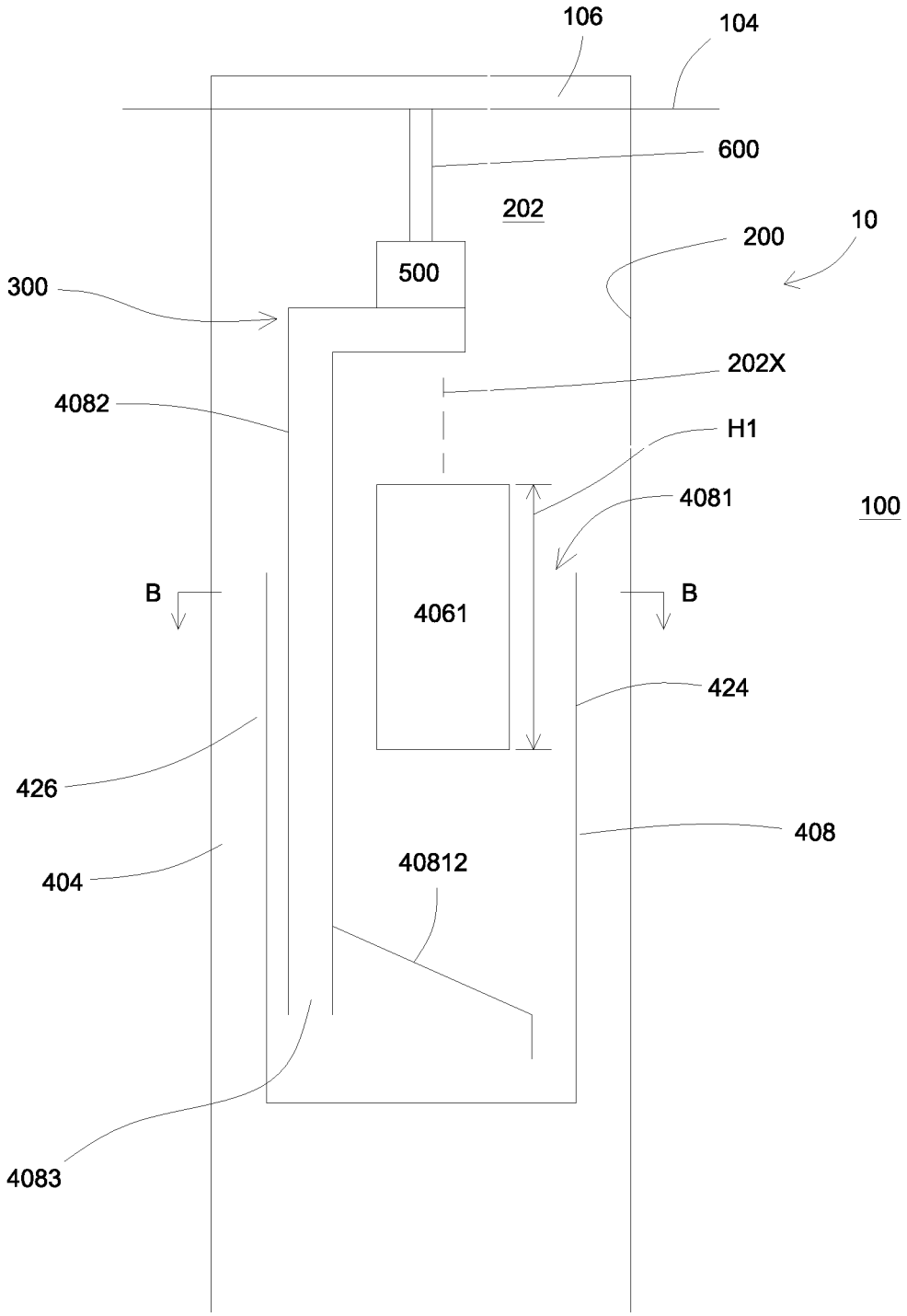
FIG. 8 is identical to the embodiment illustrated in FIG. 1, and illustrating the magnitude of the separation zone.
Figure 9:
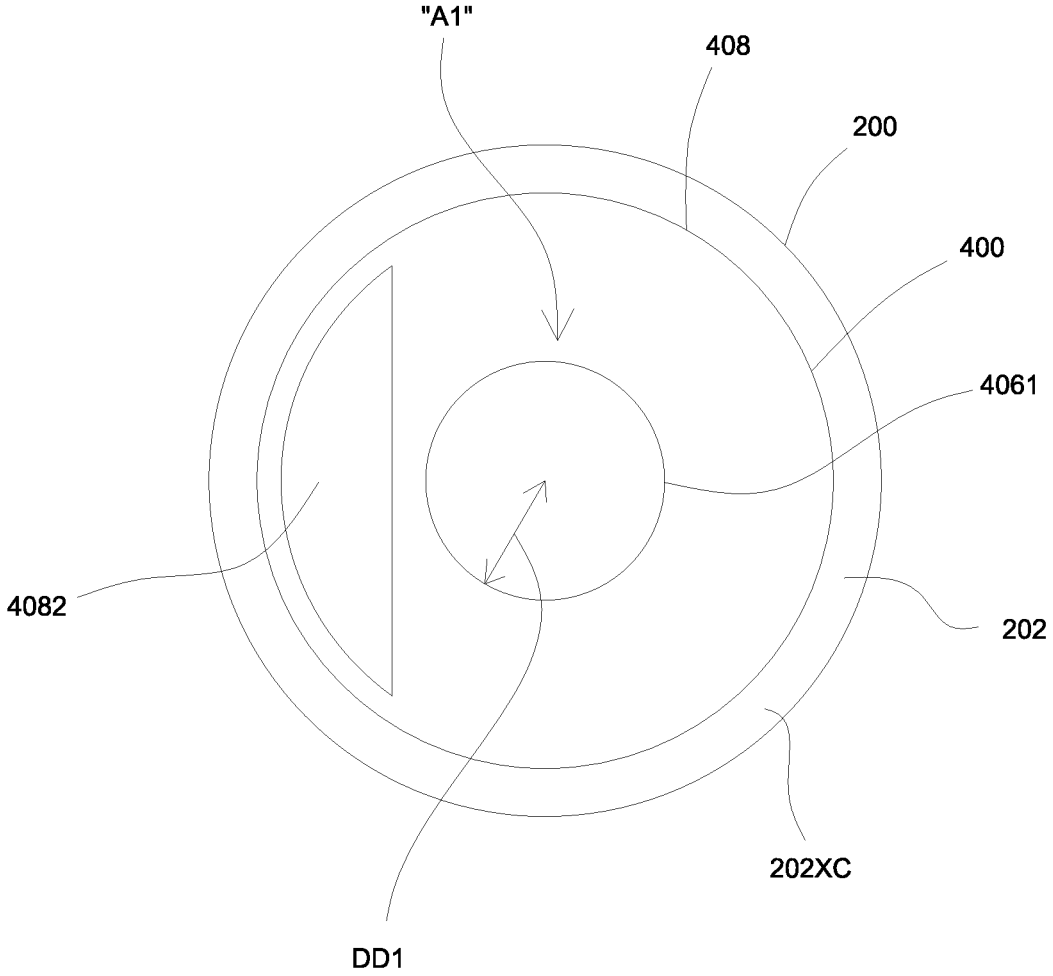
FIG. 9 is a schematic illustration of a sectional view of the embodiment illustrated in FIG. 8, taken along lines B-B.

Referring to FIGS. 8 and 9, in some embodiments, for example, the wellbore string 200 and the gas separator 400 are further co-operatively configured such that the separation zone 406 includes a cylindrical uninterrupted space 4061. In some embodiments, for example, the central longitudinal axis 202X of wellbore string passage 202 extends through the cylindrical uninterrupted space 4061.

Referring to FIG. 9, in some embodiments, for example, the wellbore string passage 202 includes a cross-section 202XC that is traversed by both of the cylindrical uninterrupted space 4061 and the pump-supplying fluid conductor 4082, and the area "A1", of the cross-section 202XC of the wellbore string passage 202, occupied by the cylindrical uninterrupted space 4061, defines at least 70% (such as, for example, at least 80%) of the total cross-sectional area of the cross-section 202XC of the wellbore string passage 202. In some of these embodiments, for example, for every one of the cross-sections of the wellbore string passage 202 that is traversed by both of the cylindrical uninterrupted space 4061 and the pump-supplying fluid conductor 4082, independently, the area, of the cross-section of the wellbore string passage 202, occupied by the cylindrical uninterrupted space 4061, defines at least 70% (such as, for example, at least 80%) of the total cross-sectional area of the cross-section of the wellbore string passage 202.

Referring to FIGS. 8 and 9, in some embodiments, for example, the cylindrical uninterrupted space 4061 has a diameter "DD1" of at least one (1) inch (such as, for example, at least 1.5 inches, such as, for example, at least two (2) inches) and a height "H1" of at least one (1) foot (such as, for example, at least two (2) feet, such as, for example, at least three (3) feet, such as, for example, at least four (4) feet, such as, for example, at least five (5) feet, such as, for example, at least six (6) feet).

Figure 10:
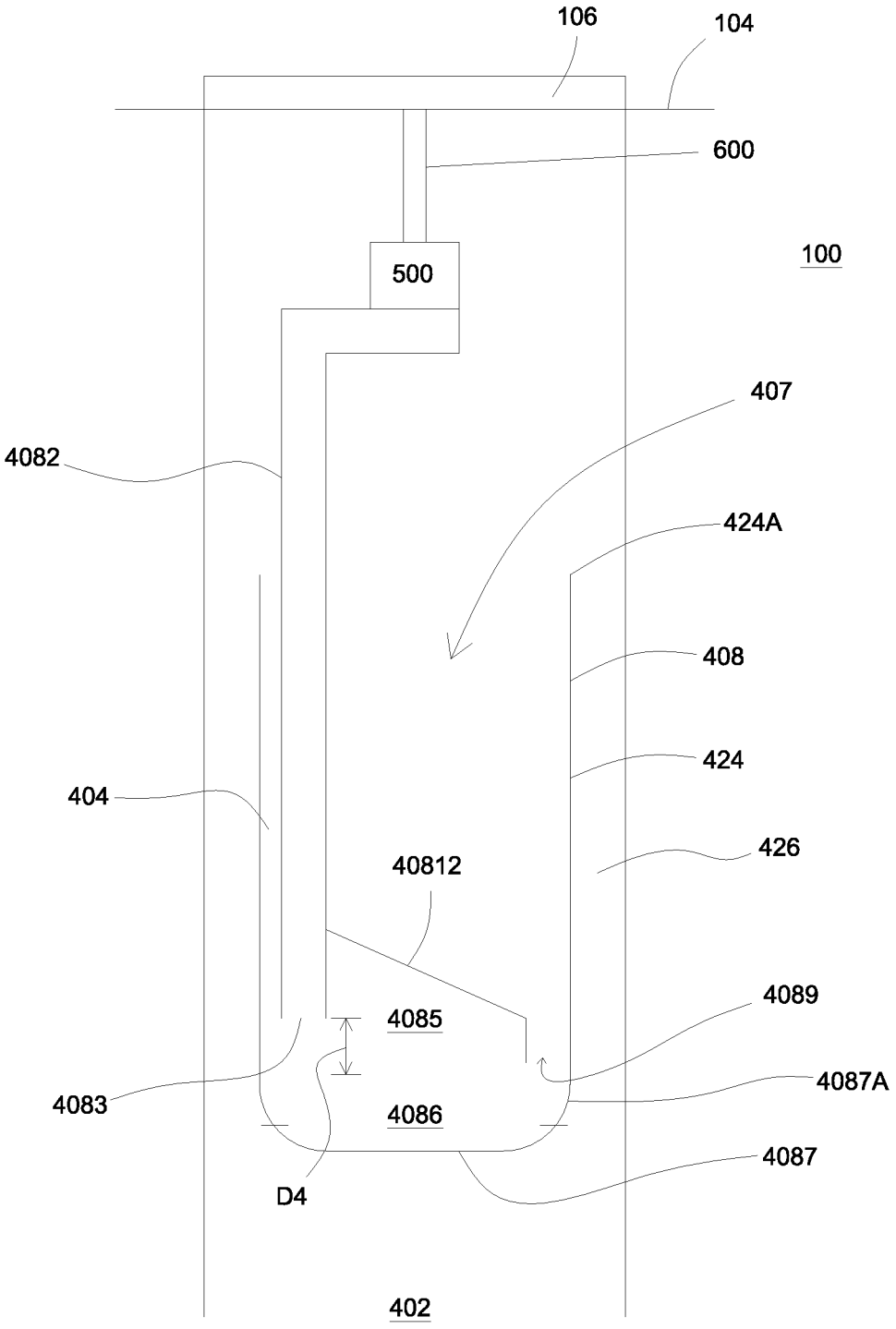
FIG. 10 is identical to the embodiment illustrated in FIG. 1, and identifying features relating to solids removal functionality of the system.
Figure 11:
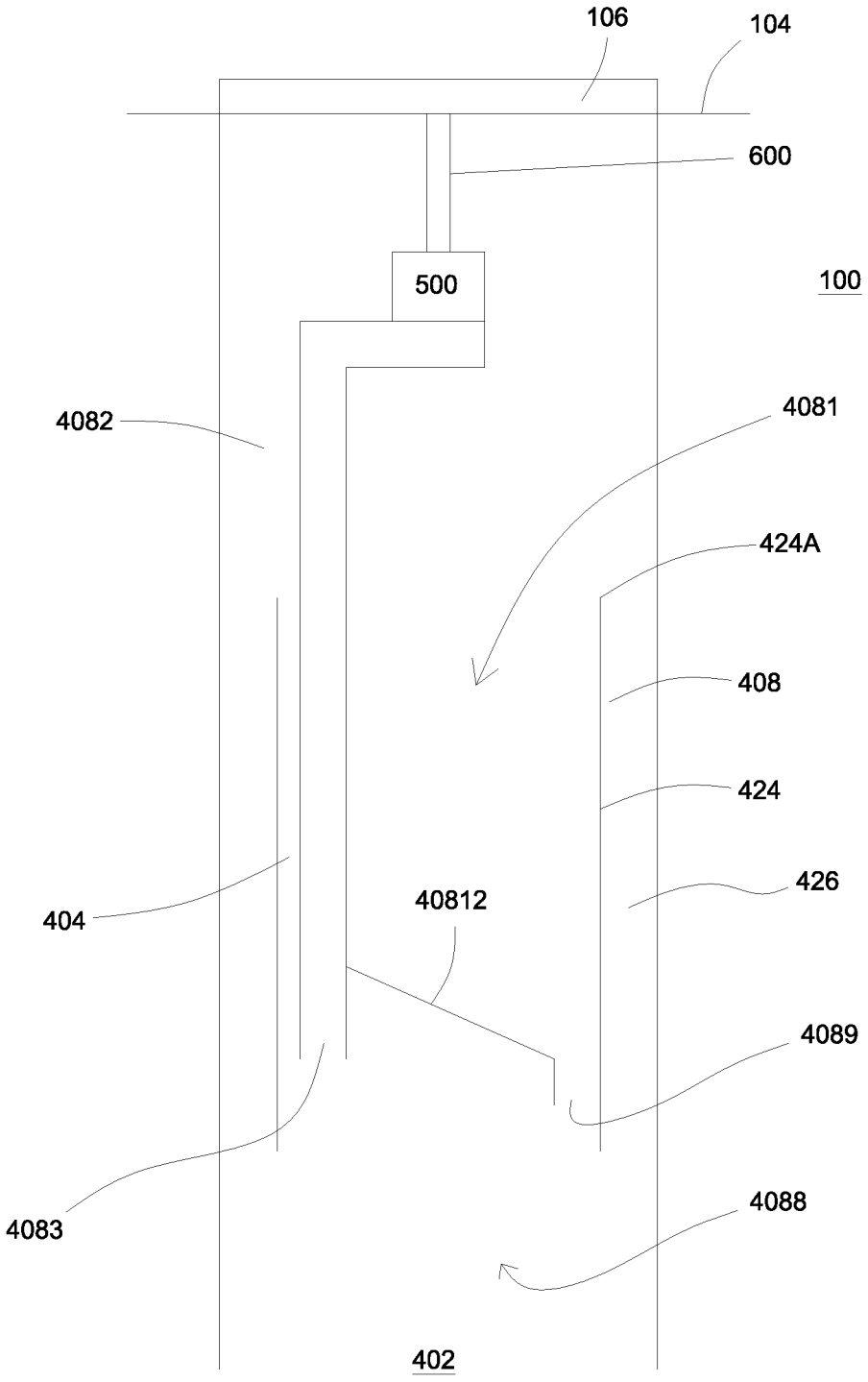
FIG. 11 is identical to the embodiment illustrated in FIG. 1, with the solids accumulation zone closure having been removed.

Referring to FIGS. 10 and 11, in some embodiments, for example, the space 4084 includes a quiescent zone 4085 for encouraging separation of solids entrained within the gas-depleted reservoir fluid, prior to the conducting of the gas-depleted reservoir fluid to the pump 500 via the pump-supplying fluid conductor 4082. In this respect, in some embodiments, for example, the flow diverter 408 further defines a solids accumulation zone 4086 for receiving solids which have separated from the gas-depleted reservoir fluid. In some embodiments, for example, the solids accumulation zone 4086 is disposed below the flow receiving communicator 4083 of the pump-supplying fluid conductor 4082.

In some embodiments, for example, the flow diverter 408 includes a removable solids accumulation zone closure 4087. In response to opening (e.g. removal) of the closure 4087, communication with the solids accumulation zone is established externally of the flow diverter 408 via a solids accumulation zone communicator 4088 (e.g. an aperture), such that accumulated solids within the solids accumulation zone 4086 are removable through the solids accumulation zone communicator 4088 (see FIG. 11). In this respect, in some embodiments, for example, the flow diverter 408 further includes a closure receiving counterpart 4087A for releasable coupling to the closure 4087, such that the closure 4087 is releasably coupled to the closure receiving counterpart 4087A, and is thereby removable from the flow diverter 408. In some embodiments, for example, the releasable coupling is a threaded coupling. In some embodiments, for example, the closure 4087 defines a solids collector for collecting and containing the accumulated solids. In some embodiments, for example, the solids collector is interchangeable with another solids collector with a different capacity for collecting and containing the accumulated solids, to better match the contemplated solids management requirements.

In some embodiments, for example, a quiescent zone flow conductor 4091, defined within the flow diverter 408, is disposed in flow communication with the flow receiving communicator 4081, for conducting at least a fraction of the downwardly-flowing reservoir fluid, such that the at least a fraction of the downwardly-flowing reservoir fluid becomes emplaced within the quiescent zone 4085 and below the pump-supplying fluid conductor flow receiver 4083, prior to the conducting of the at least a fraction of the downwardly-flowing reservoir fluid to the pump-supplying fluid conductor flow receiver 4083. In some embodiments, for example, the at least a fraction of the downwardly-flowing reservoir fluid, being conducted by the quiescent zone flow conductor 4091, is at least 50 volume % (such as, for example, at least 75 volume %) of the downwardly-flowing reservoir fluid, based on the total volume of the downwardly-flowing reservoir fluid. In some embodiments, for example, the at least a fraction of the downwardly-flowing reservoir fluid is the entirety of the downwardly-flowing reservoir fluid. In some embodiments, for example, the downwardly-flowing reservoir fluid is the downwardly-flowing gas-depleted reservoir fluid.

In some of these embodiments, for example, the quiescent zone flow conductor 4091 includes a quiescent zone flow discharging communicator 4089 (e.g. an outlet) for discharging the at least a fraction of the downwardly-flowing reservoir fluid into the quiescent zone 4085, and the quiescent zone flow discharging communicator 4089 is disposed below the pump-supplying fluid conductor flow receiver 4083. In this respect, the at least a fraction of the downwardly-flowing reservoir fluid, being conducted to the flow receiver 4083 of the pump-supplying flow conductor 4082, via the quiescent zone flow conductor 4091, is diverted to a space (within the quiescent zone 4085) disposed below the flow receiver 4083, changes direction, and is then conducted uphole to the flow receiver 4083. This change in direction of the flow of the downwardly-flowing reservoir fluid promotes separation of solid material from the downwardly-flowing reservoir fluid, prior to receiving of the downwardly-flowing reservoir fluid by the flow receiver 4083. In some embodiments, for example, the quiescent zone flow discharging communicator 4089 is disposed below the flow receiver 4083 by a distance "D4", measured along an axis that is parallel to a central longitudinal axis 202X of the wellbore string passage 202, of at least one (1) millimetre. In some embodiments, for example, the ratio of the cross-sectional flow area, defined by the flow receiving communicator 4081 of the flow diverter 408, to the cross-sectional flow area defined by the quiescent zone flow discharging communicator 4089 is at least three (3), such as, for example, at least five (5), such as, for example, at least ten (10), such as, for example, at least 20. In some embodiments, for example, the cross-sectional flow area defined by the quiescent zone flow discharging communicator 4089 is at least 0.196 square inches, such as, for example, at least 0.785 square inches. In some embodiments, for example, the quiescent zone flow discharging communicator 4089 is spaced apart from the flow receiver 4083 of the pump-supplying flow conductor 4082 by a distance sufficient to provide sufficient time for any solids, entrained within the gas-depleted reservoir fluid, to separate in response to gravity separation, with effect that the separated solids accumulate within the solids accumulation zone 4088, and solids entrainment, within the gas-depleted reservoir fluid being conducted to the pump 500, is mitigated. In some embodiments, for example, the quiescent zone flow discharging communicator 4089 is disposed adjacent to a side of the flow diverter 408 that is opposite to the side of the flow diverter 408 to which the flow receiver 4083 is adjacent. In some embodiments, for example, the distance of the closest flowpath "FP" between the quiescent zone flow receiving communicator 4089 and the flow receiver 4083 of the pump-supplying fluid conductor 4082 is greater than two (2) inches, such as, for example, greater than four (4) inches, such as, for example, greater than six (6) inches.

Figure 17:
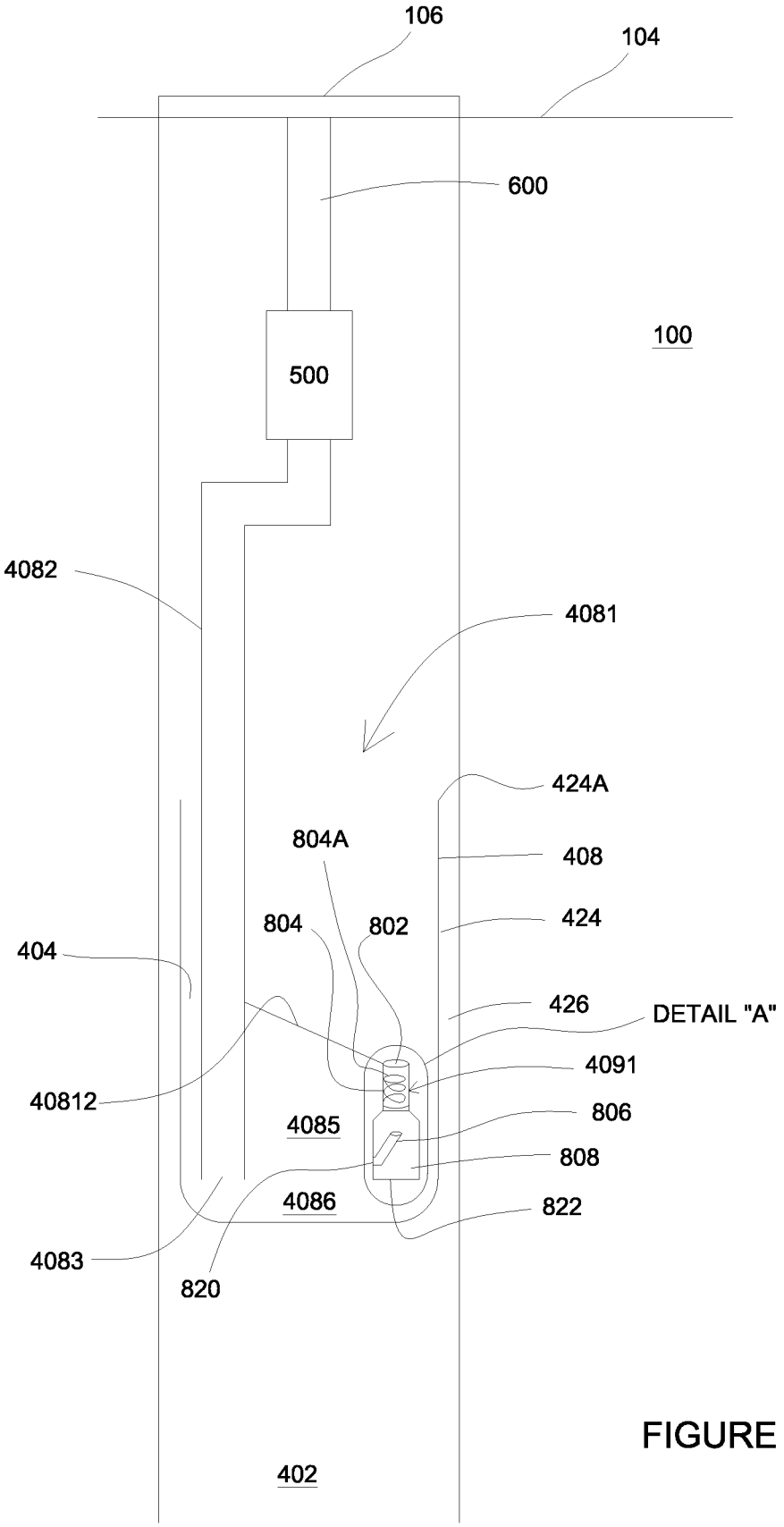
FIG. 17 is a schematic illustration of another embodiment of the present disclosure.
Figure 18:
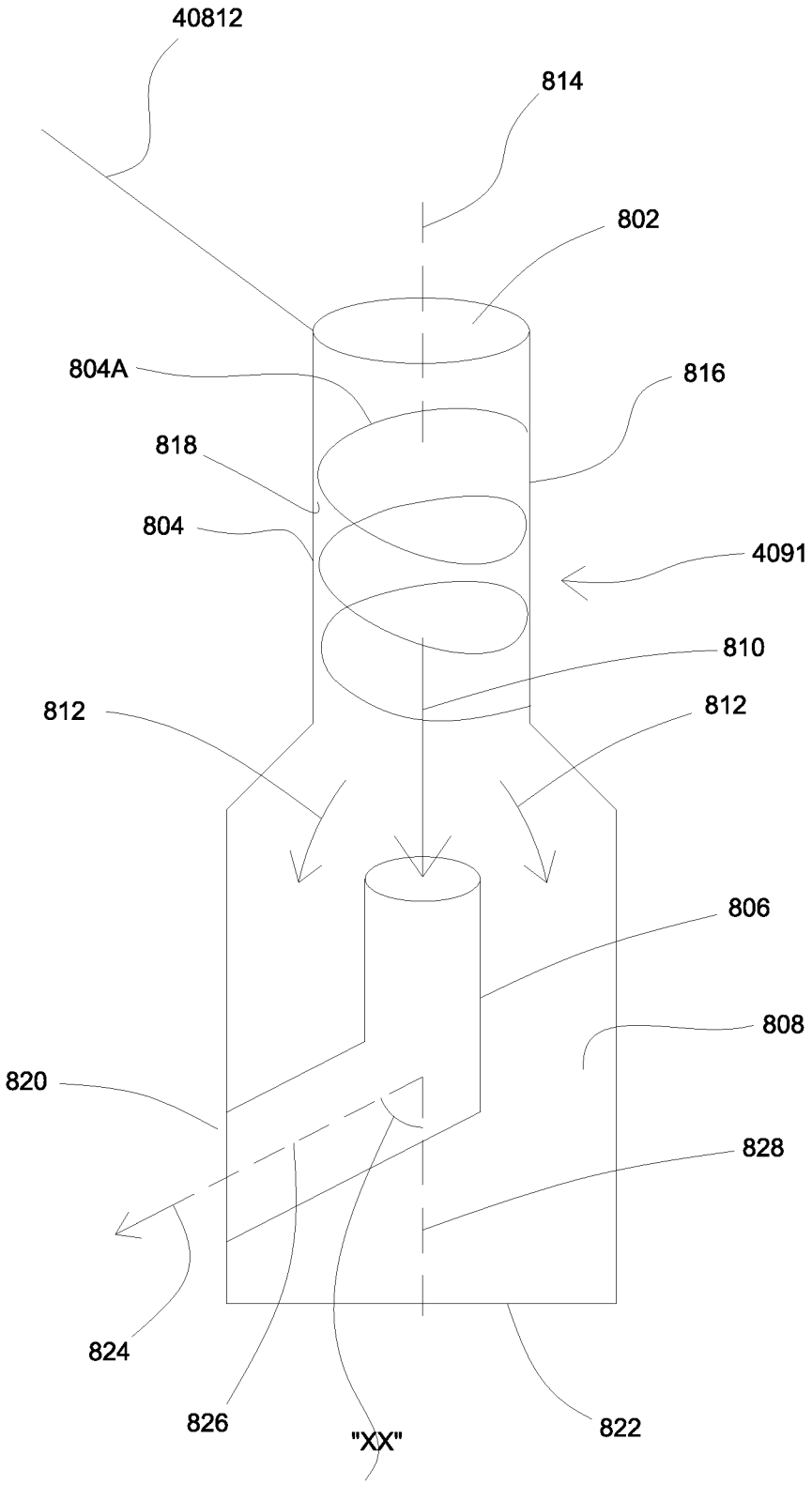
FIG. 18 is an enlarged portion of Detail "A" of the embodiment illustrated in FIG. 17.

Referring to FIGS. 17 and 18, in some embodiments, for example, the quiescent zone flow conductor 4091 includes a flow receiver 802, an uphole conductor portion 804, a solids-lean reservoir fluid flow-conducting conductor portion 806, and a solids-rich fluid flow-conducting conductor portion 808. The flow receiver 802 is configured for receiving the downwardly flowing reservoir fluid. The uphole conductor portion 804 defines a contoured surface 804A (e.g. "rifled" surface) configured to induce torsional flow in the received downwardly flowing reservoir fluid, with effect that the at least a fraction of the downwardly flowing reservoir fluid separates into a solids-lean reservoir fluid flow 810 and a solids-rich reservoir fluid flow 812. Relative to the solids-lean reservoir fluid flow 810, the solids-rich reservoir fluid flow 812 is disposed further outwardly from the central longitudinal axis 814 of the quiescent zone flow conductor 4091. In some embodiments, for example, the conductor 4091 includes a metal tubular carrier 816, and the contoured surface 804A is defined by an insert 818 that is bonded (for example, with an epoxy) to the carrier 818. The solids-lean reservoir fluid flow-conducting conductor portion 806, defining a solids-lean reservoir fluid flow-discharging communicator 820. The solids-rich reservoir fluid flow-conducting conductor portion 808 defines a solids-rich reservoir fluid flow-discharging communicator 822. The uphole conductor portion 804, the solids-lean reservoir fluid flow-conducting conductor portion 806, and solids-rich reservoir fluid flow-conducting conductor portion 808 are cooperatively configured such that: (i) the solids-lean reservoir fluid flow-conducting conductor portion 806 is positioned, relative to the uphole conductor portion 804, for receiving the solids-lean reservoir fluid flow and conducting the solids-lean reservoir fluid flow to the solids-lean reservoir fluid flow-discharging communicator 820 for discharging into the quiescent zone 4085, and the solids-rich reservoir fluid flow-conducting conductor portion 808 is positioned, relative to the uphole conductor portion 804, for receiving the solids-rich reservoir fluid flow and conducting the solids-rich reservoir fluid flow to the solids-rich reservoir fluid flow-discharging communicator 822 for discharging into the quiescent zone 4085. The solids-lean reservoir fluid flow-discharging communicator 820 is disposed above the solids-rich reservoir fluid-flow discharging communicator 822. In some embodiments, for example, the solids-lean reservoir fluid flow-discharging communicator 820 is oriented relative to the solids-rich reservoir fluid flow-discharging communicator 822 such that a ray 824, disposed along the central axis 826 of the solids-lean reservoir fluid flow-discharging communicator 820, is disposed in a downhole direction at an acute angle "XX" of at least 15 degrees (such as, for example, at least 20 degrees, such as, for example, at least 25 degrees, such as, for example, at least 30 degrees, such as, for example, at least 35 degrees, such as, for example, at least 40 degrees, such as, for example, at least 45 degrees) relative to the central axis 828 of the solids-rich reservoir fluid flow-discharging communicator 822. In some embodiments, for example, the solids-lean reservoir fluid flow-discharging communicator 820 is disposed below the pump-supplying fluid conductor flow receiver 4083 by a distance of at least one (1) millimetre, measured along an axis that is parallel to a central longitudinal axis of the wellbore string passage. In some embodiments, for example, the distance of the closest flowpath, between the solids-rich reservoir fluid flow-discharging communicator 822 and the pump-supplying fluid conductor flow receiver 4083, is greater than two (2) inches. In some embodiments, for example, the distance of the closest flowpath, between the solids-lean reservoir fluid flow-discharging communicator 820 and the pump-supplying fluid conductor flow receiver 4083, is greater than two (2) inches.

Figure 12:
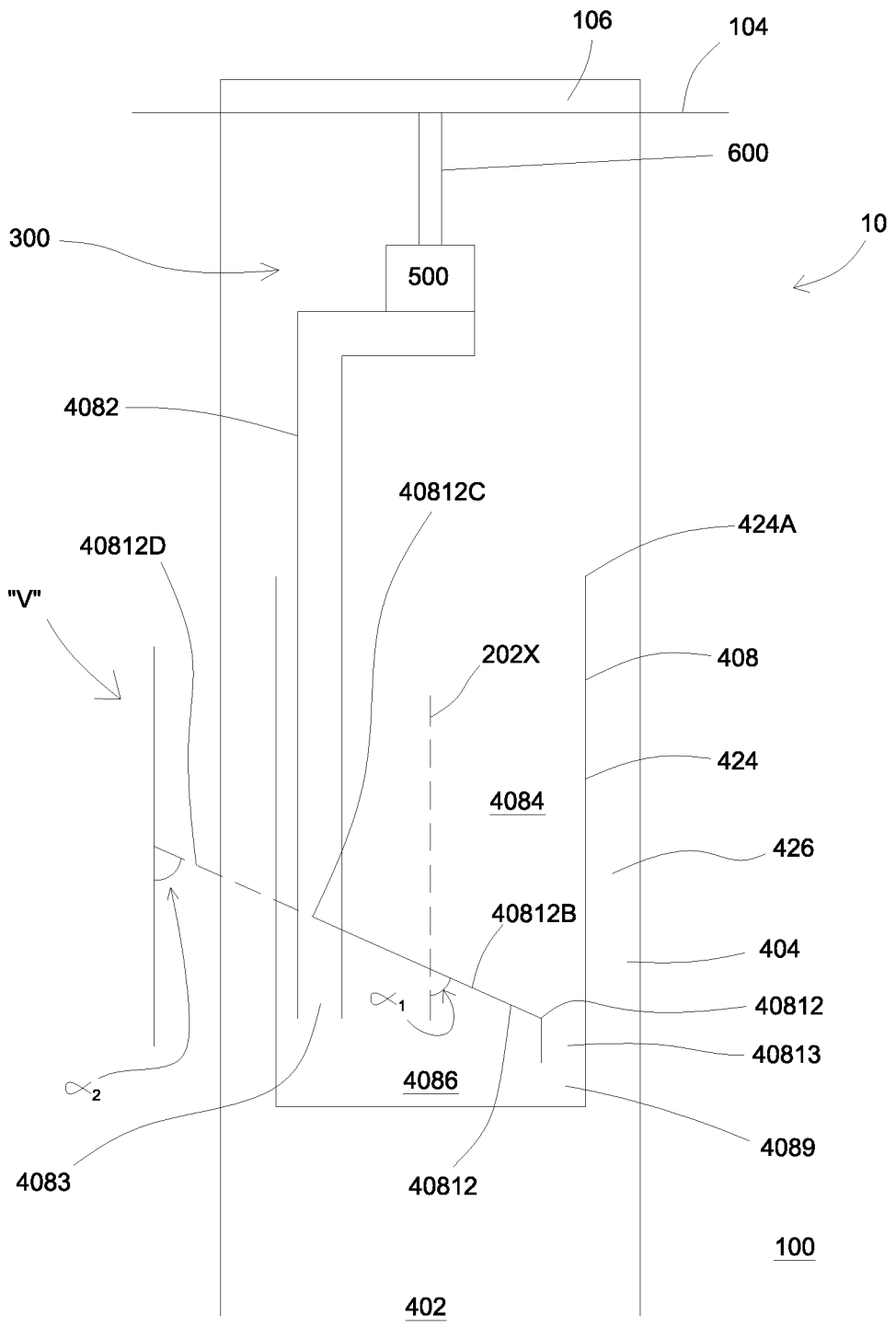
FIGS. 12 and 13 are identical to the embodiment illustrated in FIG. 1, and identifying further features relating to solids removal functionality of the system.
Figure 13:
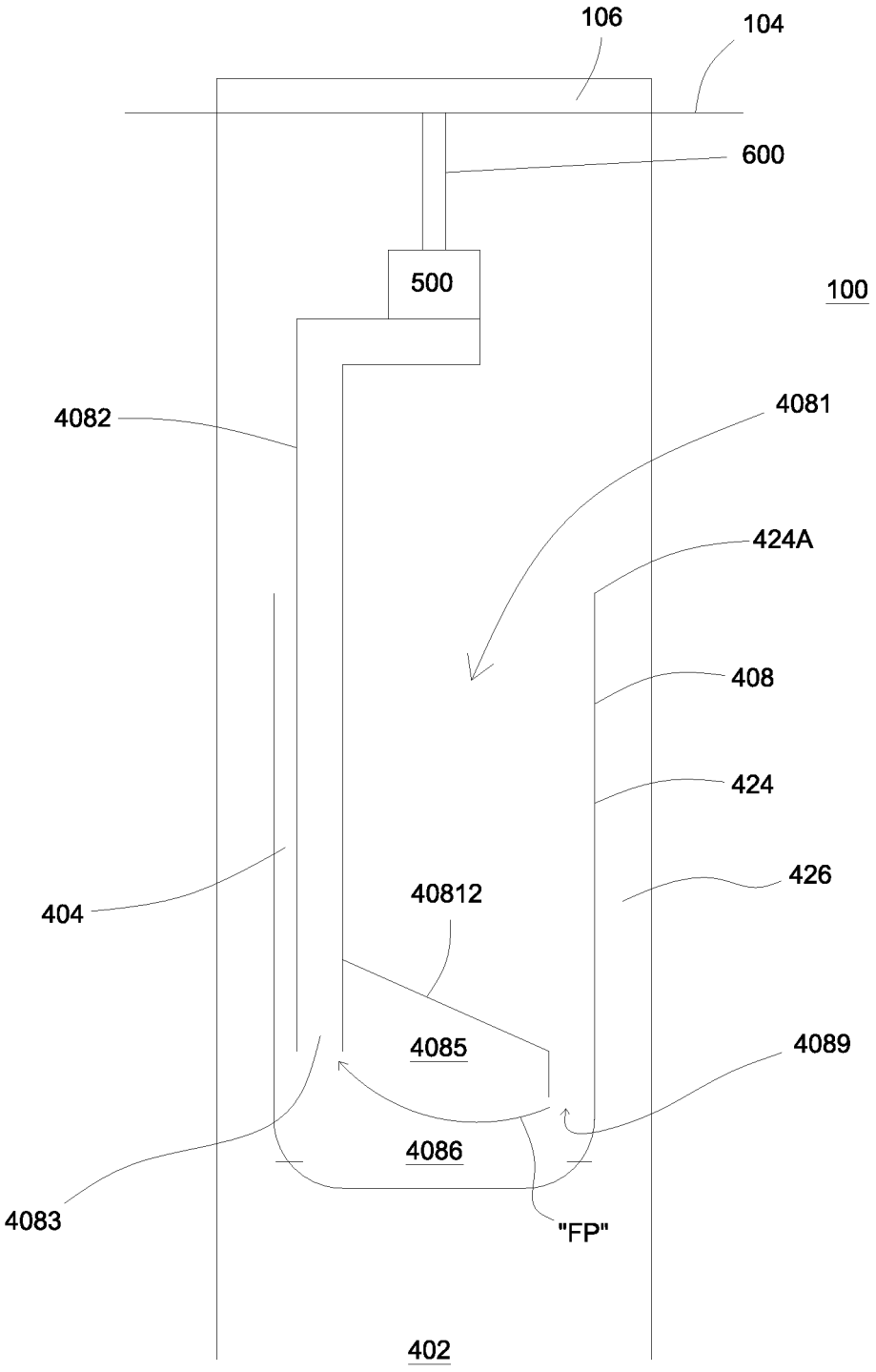

Referring to FIGS. 12 and 13, in some embodiments, for example, the flow diverter 408 includes a baffle 40812 disposed within the space 4084 for directing the downwardly-flowing gas-depleted reservoir fluid towards the quiescent zone flow conductor 4091, prior to its receiving by the flow receiver 4083 of the pump-supplying fluid conductor 4082. In this respect, the baffle 40812 is disposed between the flow receiving communicator 4081 and the flow receiver 4083 of the pump-supplying fluid conductor 4082, and includes a terminal end 40812A which leads into the quiescent zone flow conductor 4091. Also in this respect, flow communication between the flow receiving communicator 4081 and the flow receiver 4083 is effected via the quiescent zone flow conductor 4091. In some embodiments, for example, the quiescent zone flow conductor 4091 is defined by a dip tube 40813, extending downwardly from the baffle 40812.

In some embodiments, for example, the baffle 40812 extends in a downwardly direction, towards the quiescent zone flow conductor 4091, and defines an uphole-facing surface 40812B for interfering with the downwardly flow of the gas-depleted reservoir fluid.

In some embodiments, for example, an axis 40812C, disposed parallel to the uphole-facing surface 40812B, is disposed at an acute angle "a1", relative to the central longitudinal axis 202X of the wellbore string passage 202, that is less than 70 degrees.

In some embodiments, for example, an axis 40812DC, disposed parallel to the uphole-facing surface 4022B, is disposed at an acute angle "$\alpha$2", relative to the vertical "V", that is less than 70 degrees.

Figure 14:
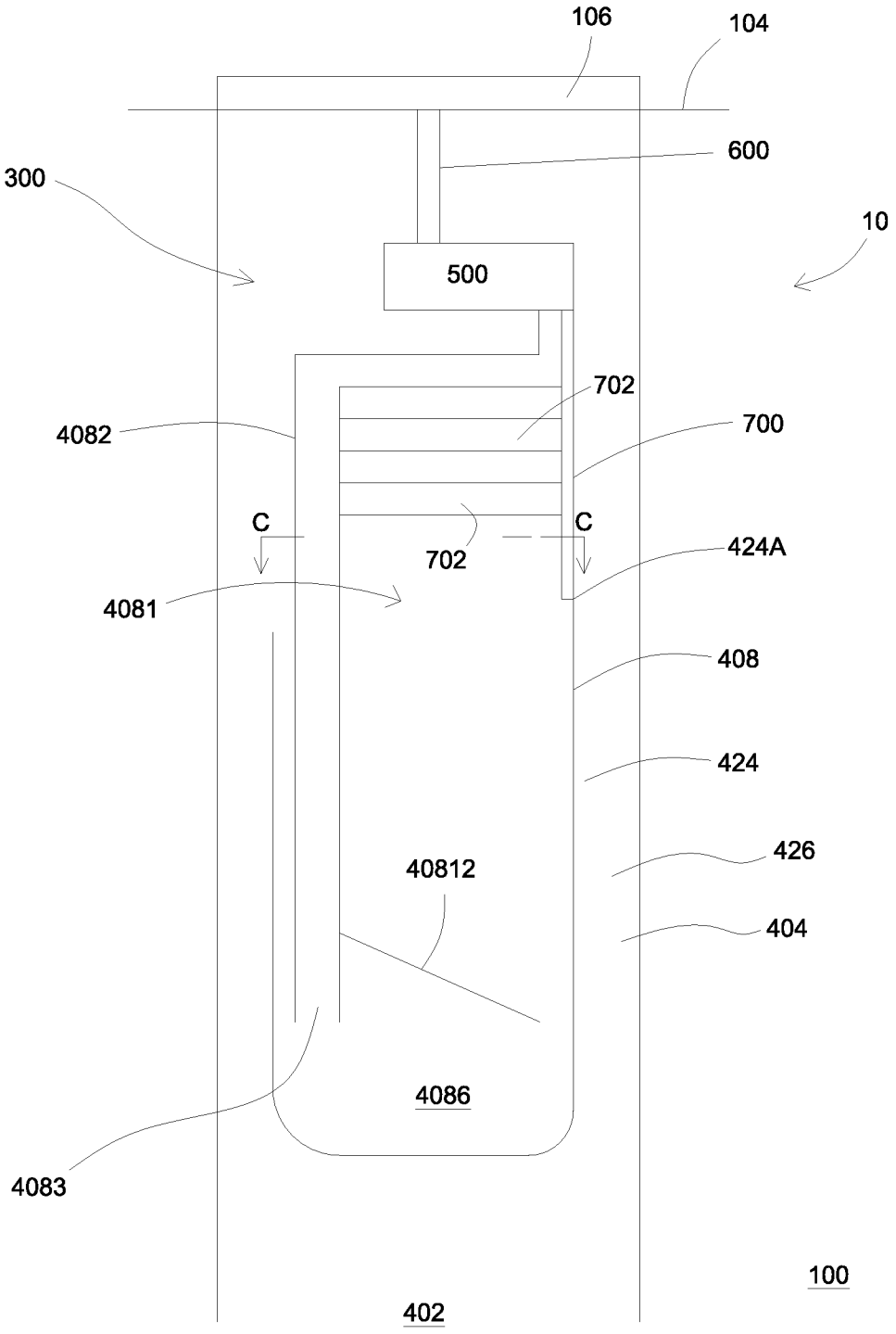
FIG. 14 is a schematic illustration of another embodiment of the present disclosure.
Figure 15:
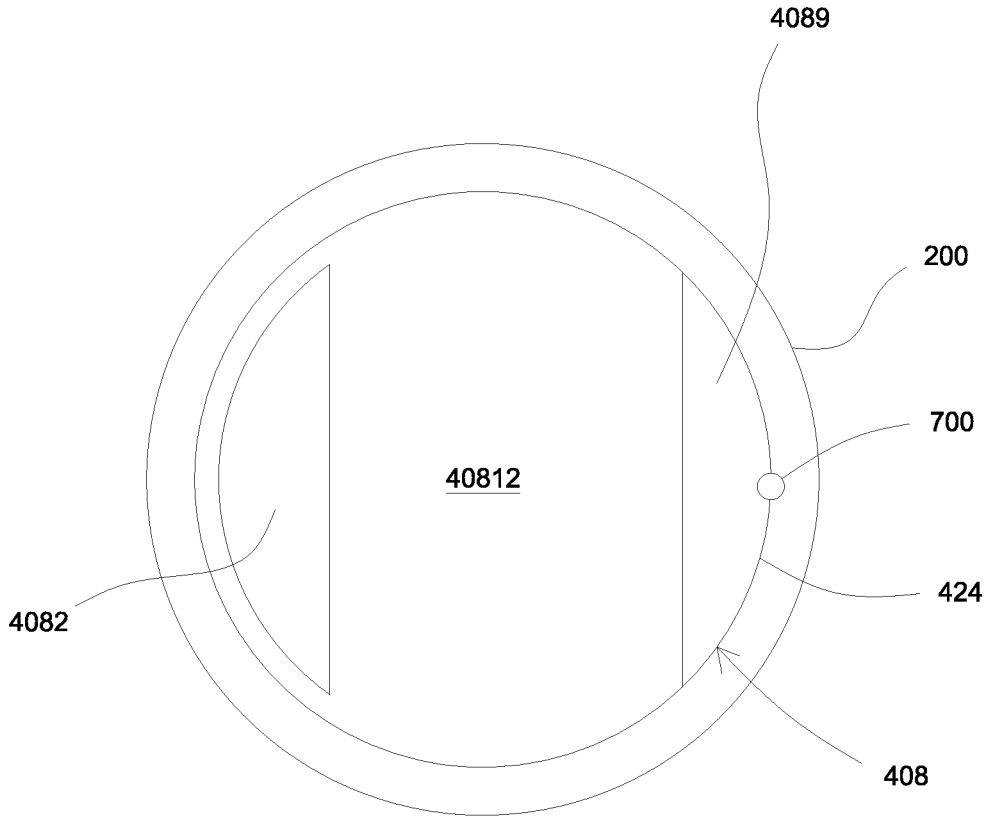
FIG. 15 is a schematic illustration of a sectional view taken along lines C-C in FIG. 14.

Referring to FIGS. 14 and 15, in some embodiments, for example, the shroud 424 is supported by an elongated member 700 connected to the pump-supplying fluid conductor 4082. In some embodiments, for example, the elongated member is in the form of a rigid bar. In some embodiments, for example, the rigid bar has a maximum cross-sectional area of less than 0.5 square inches. In some embodiments, for example, the elongated member 700 is connected to the pump-supplying fluid conductor 4082 with a plurality of gusset braces 702. In this respect, for each one of the gusset braces 702, independently, the gusset brace 702 connects a respective portion of the elongated member 700 to a counterpart portion of the pump-supplying fluid conductor 4082.

Figure 16:
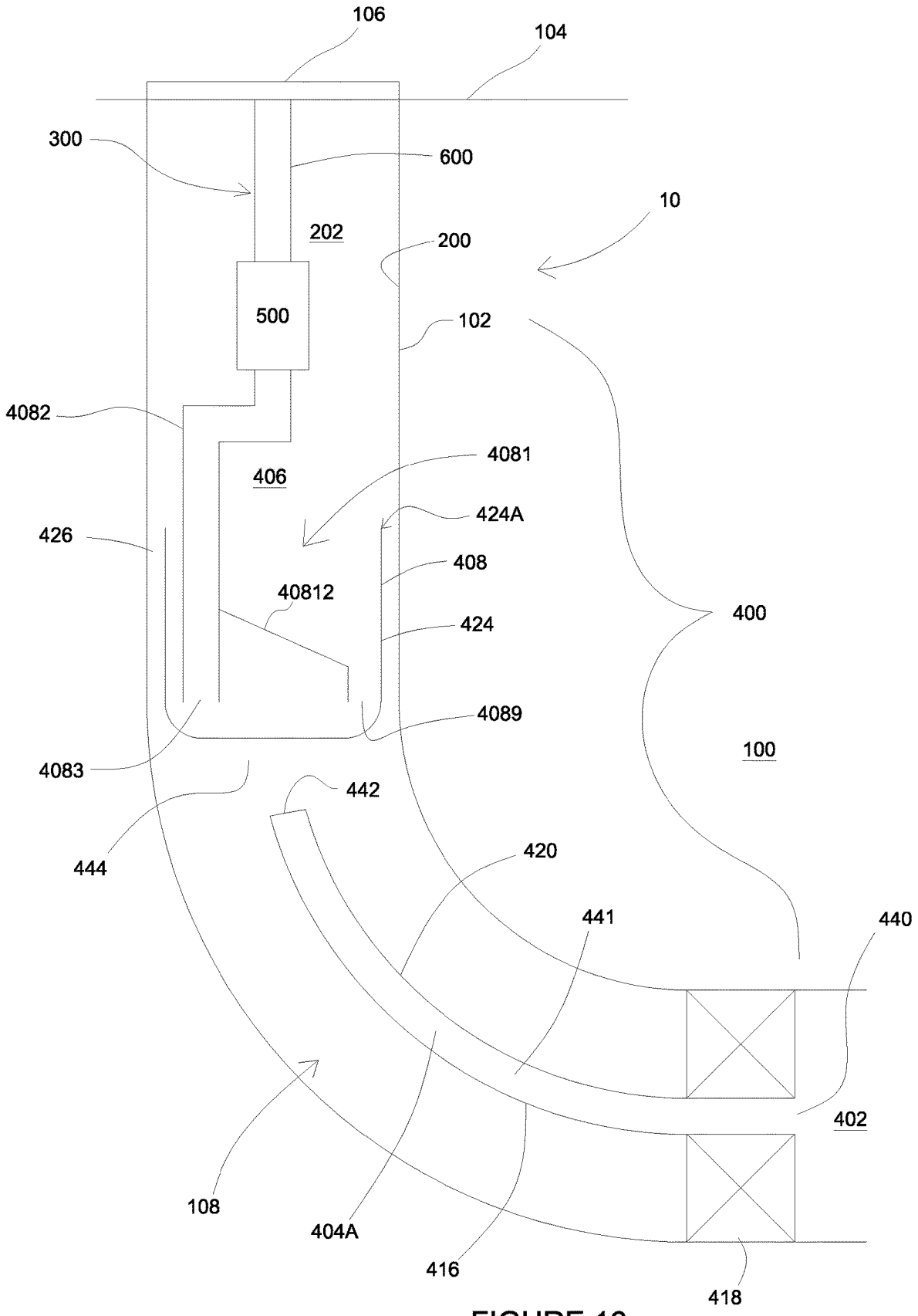
FIG. 16 is a schematic illustration of another embodiment of the present disclosure.

Referring to FIG. 16, in some embodiments, for example, the gas separator 400 further includes a reservoir fluid conductor 416 and a sealed interface effector 418 (such as, for example, a packer). At least a portion 404A of the reservoir fluid-conducting passage 404 is defined within the reservoir fluid conductor 416. The sealed interface effector 418 is mounted to the reservoir fluid conductor 416 such that the reservoir fluid conductor 416 is sealingly engaged to the wellbore string 200 via the sealed interface effector 418.

In some embodiments, for example, at least a portion of the reservoir fluid conductor 416 is a velocity string 420. In some embodiments, for example, the at least a portion of the reservoir fluid conductor 416 is the entirety of the reservoir fluid conductor 416, such that, in such embodiments, the velocity string is the reservoir fluid conductor 416. In some embodiments, for example, the sealing engagement of the reservoir fluid conductor 416 to the wellbore string 200 is a sealing engagement of the velocity string 420 to the wellbore string. In this respect, in some embodiments, for example, the sealed interface effector 418 is mounted to the velocity string 420.

In those embodiments where at least a portion of the reservoir fluid conductor 416 is a velocity string 420, in some of these embodiments, for example, the velocity string 420 is characterized by a maximum cross-sectional flow area, and the maximum cross-sectional flow area is smaller than the minimum cross-sectional flow area of the reservoir fluid-receiving space 402. In some of these embodiments, for example, the ratio of the minimum cross-sectional flow area of the reservoir fluid-receiving space 402 to the maximum cross-sectional flow area of the reservoir fluid conducting passage portion 404A, defined by the velocity string 420, is at least 1.5.

In those embodiments where at least a portion of the reservoir fluid conductor 416 is a velocity string 420, in some of these embodiments, for example, at least a portion of the velocity string 420 is disposed within a heel portion 108 of the wellbore 102. In some embodiments, for example, the velocity string 420 extends through the heel portion 108.

In some embodiments, for example, the reservoir fluid conductor 416 includes a flow receiving communicator 440 (such as, for example, an inlet port), a flow discharging communicator 442 (such as, for example, an outlet port), and a reservoir fluid conductor flow passage 441. The reservoir fluid conductor flow passage 441 defines a portion of the reservoir fluid-conducting passage 404. The flow receiving communicator 440 is disposed for receiving the reservoir fluid from the reservoir fluid-receiving zone 402 such that the conducting of the reservoir fluid, by the reservoir fluid-conducting passage 404, is effected while the reservoir fluid is being received by the flow receiving communicator 440 from the reservoir fluid-receiving zone 402. The reservoir fluid conductor flow passage 441 is effective for conducting the reservoir fluid received by the flow receiving communicator 440 to the flow discharging communicator 442. The flow discharging communicator 442 is effective for discharging the reservoir fluid from the reservoir fluid conductor 416.

The flow diverter 408, the wellbore string 200, the reservoir fluid conductor 416, and the sealed interface effector 418 are co-operatively configured such that:

- the intermediate passage 426 is disposed between the flow diverter 408 and the wellbore string 200 and defines another portion of the reservoir fluid-conducting passage 404;
- the flow discharging communicator 442 is disposed in flow communication with the reservoir fluid separation zone 406 via the intermediate passage 426;
- while reservoir fluid is being discharged from the flow discharging communicator 442, the discharged reservoir fluid is diverted by the sealed interface effector 418 to the intermediate passage 426 for conduction to the reservoir fluid separation zone 406.

In some of these embodiments, for example, the flow diverter 408 is disposed above the flow discharging communicator 442, such that a bubble coalescent zone 444 is defined between the flow discharging communicator 442 and the flow diverter 408. In some embodiments, for example, the minimum spacing distance from the flow discharging communicator 442 to the flow diverter 408 is at least five (5) feet, such as, for example, at least ten (10) feet, such as, for example, at least 20 feet, such as, for example, at least 30 feet. In some embodiments, for example, the minimum spacing distance from the flow discharging communicator 442 to the intermediate passage is at least five (5) feet, such as, for example, at least ten (10) feet, such as, for example, at least 20 feet, such as, for example, at least 30 feet. The minimum cross-sectional flow area of the bubble coalescent zone 444 is greater than the maximum cross-sectional flow area of the reservoir fluid conducting passage portion 404A of the reservoir fluid conductor 416 (such as, for example, the velocity string 420). In some embodiments, for example, the ratio, of the minimum cross-sectional flow area of the bubble coalescent zone 444 to the maximum cross-sectional flow area of the reservoir fluid conducting passage portion 404A of the reservoir fluid conductor 416 (such as, for example, the velocity string 420), is at least 1.5. The bubble coalescent zone 444 is configured to reduce the velocity of the reservoir fluid flow being discharged from the reservoir fluid conductor 416, and mitigate turbulent flow conditions, so as to promote bubble coalescence, which facilitates the separation within the separation zone 404. In this respect, the conducting of the reservoir fluid from the reservoir fluid-receiving space 402 to the separation space 404 is effected via at least the reservoir fluid-conducting passage portion 404A of the reservoir fluid conductor 416 (such as, for example, the velocity string 420), the bubble coalescent zone 444, and the intermediate space 426.

In the above description, for purposes of explanation, numerous details are set forth in order to provide a thorough understanding of the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. Therefore, it will be understood that certain adaptations and modifications of the described embodiments can be made and that the above discussed embodiments are considered to be illustrative and not restrictive. All references mentioned are hereby incorporated by reference in their entirety.

What is claimed is:

1. A system comprising a separator, emplaced within a wellbore string passage of a wellbore string that is lining a wellbore through which hydrocarbon material is producible from an oil reservoir within a subterranean formation, wherein:

- the separator and the wellbore string are co-operatively configured such that, in response to inducement by a pump:
  - while reservoir fluid is disposed within a reservoir fluid-receiving zone, disposed within the wellbore string passage, the reservoir fluid is conducted upwardly, via an annular passage disposed between the separator and the wellbore string, from the reservoir fluid-receiving zone to a gas separation zone, disposed within the wellbore string passage, such that the reservoir fluid becomes emplaced within the gas separation zone, with effect that the reservoir fluid flow is separated into at least a downwardly-flowing gas-depleted reservoir fluid and an upwardly flowing gas-enriched reservoir fluid, wherein the separation includes separation in response to buoyancy forces within the gas separation zone; and while the separated gas-depleted reservoir fluid is flowing downwardly from the gas separation zone, the separator diverts the downwardly-flowing gas-depleted reservoir fluid such that the downwardly-flowing gas-depleted reservoir changes direction and an upwardly-flowing gas-depleted reservoir fluid, being conducted via an upwardly-conducting gas-depleted reservoir fluid conductor, is established, such that the separator includes the upwardly-conducting gas-depleted reservoir fluid conductor;

wherein:

the gas separation zone co-operates with the reservoir fluid, emplaced within the gas separation zone, such that the reservoir fluid, emplaced within the gas separation zone, occupies the gas separation zone, such that the gas separation zone is occupied by the reservoir fluid only;

and the wellbore string passage defines a separation-promoting cross-section, traversed by both of the gas separation zone and the upwardly-conducting gas-depleted reservoir fluid conductor, and the area of the separation-promoting cross-section of the wellbore string passage, occupied by the gas separation zone, includes a circular area, and the circular area defines at least 70% of the total cross-sectional area of the separation-promoting cross-section of the wellbore string passage.

2. The system as claimed in claim 1;

wherein:

the separator and the wellbore string are further co-operatively configured such that the separation-promoting cross-section, of the wellbore string passage, is disposed within a vertical section of the wellbore.

3. The system as claimed in claim 1;

wherein:

the gas separation zone includes a cylindrical space, traversing the cross-section, and the cylindrical space has a diameter of at least one (1) inch and a height of at least 12 inches.

4. The system as claimed in claim 1;

wherein:

the reservoir fluid includes entrained solids.

5. The system as claimed in claim 1;

wherein:

the circular area of the separation-promoting cross-section of the wellbore string passage, occupied by the gas separation zone, defines at least 80% of the total cross-sectional area of the separation-promoting cross-section of the wellbore string passage.

6. The system as claimed in claim 1;

wherein:

the separator defines a flow receiving communicator, such that receiving of the downwardly-flowing gas-depleted reservoir fluid by the separator, for the diverting, is effected by the flow receiving communicator; and the ratio, of (i) the cross-sectional flow area of the separation-promoting cross-section of the wellbore string passage, to (ii) the cross-sectional flow area of the flow receiving communicator, is less than 1.1:1.

7. The system as claimed in claim 1;

further comprising:

a pressurized gas-depleted reservoir fluid conductor for conducting the gas-depleted reservoir fluid, that has been pressurized by the pump, to the surface;

wherein:

the pump fluidly coupled to the upwardly-conducting gas-depleted reservoir fluid conductor; and the pressurized gas-depleted reservoir fluid conductor and the wellbore string are co-operatively configured such that a gas-enriched reservoir fluid-conducting passage is defined within a space disposed between the pressurized gas-depleted reservoir fluid conductor and the wellbore string; and the gas-enriched reservoir fluid-conducting passage is disposed in fluid communication with the gas separation zone for conducting the upwardly flowing gas-enriched reservoir fluid from the gas separation zone.

8. The system as claimed in claim 1;

wherein:

the wellbore string is a casing string.

9. A system comprising a separator, emplaced within a wellbore string passage of a wellbore string that is lining a wellbore through which hydrocarbon material is producible from an oil reservoir within a subterranean formation, wherein:

the separator and the wellbore string are co-operatively configured such that, in response to inducement by a pump:

while reservoir fluid, is disposed within a reservoir fluid-receiving zone, disposed within the wellbore string passage, the reservoir fluid is conducted upwardly, via an annular passage disposed between the separator and the wellbore string, from the reservoir fluid-receiving zone to a gas separation zone, disposed within the wellbore string passage, such that the reservoir fluid becomes emplaced within the gas separation zone, with effect that the reservoir fluid flow is separated into at least a downwardly-flowing gas-depleted reservoir fluid and an upwardly flowing gas-enriched reservoir fluid, wherein the separation includes separation in response to buoyancy forces within the gas separation zone; and while the separated gas-depleted reservoir fluid is flowing downwardly from the gas separation zone, the separator diverts the downwardly-flowing gas-depleted reservoir fluid such that the downwardly-flowing gas-depleted reservoir changes direction and an upwardly-flowing gas-depleted reservoir fluid, being conducted via an upwardly-conducting gas-depleted reservoir fluid conductor, is established, such that the separator includes the upwardly-conducting gas-depleted reservoir fluid conductor;

wherein:

the gas separation zone co-operates with the reservoir fluid, emplaced within the gas separation zone, such that the reservoir fluid, emplaced within the gas separation zone, occupies the gas separation zone, such that the gas separation zone is occupied by the reservoir fluid only;

and the upwardly-conducting gas-depleting reservoir fluid conductor includes an eccentrically-disposed portion, disposed eccentrically relative to a central longitudinal axis of the wellbore string and the eccentrically-disposed portion is disposed laterally relative to an adjacent portion of the gas separation zone.

10. The system as claimed in claim 9;

wherein:

the reservoir fluid includes entrained solids.

11. The system as claimed in claim 9;
wherein:
the eccentrically-disposed portion is spaced-apart from the wellbore string by less than 0.75 inches.

12. The system as claimed in claim 9;
wherein:
the eccentrically-disposed portion is spaced-apart from the wellbore string by less than 0.5 inches.

13. The system as claimed in claim 9;
wherein:
the cross-sectioned profile of the eccentrically-disposed portion is non-circular.

14. The system as claimed in claim 9;
wherein:
the eccentrically-disposed portion has a total length of at least six (6) feet.

15. The system as claimed in claim 9;
wherein:
the separation zone is disposed within a vertical section of the wellbore.

16. The system as claimed in claim 9;
wherein:
the separator defines a flow receiving communicator, such that receiving of the downwardly-flowing gas-depleted reservoir fluid by the separator, for the diverting, is effected by the flow receiving communicator; and
the ratio, of (i) the cross-sectional flow area of a traversed portion of the wellbore string passage that is traversed by the adjacent portion of the gas separation zone, to (ii) the cross-sectional flow area of the flow receiving communicator, is less than 1.1:1.

17. The system as claimed in claim 9;
further comprising:
the pump fluidly coupled to the upwardly-conducting gas-depleted reservoir fluid conductor, and;
a pressurized gas-depleted reservoir fluid conductor for conducting the gas-depleted reservoir fluid, that has been pressurized by the pump, to the surface;
wherein:
the pressurized gas-depleted reservoir fluid conductor and the wellbore string are co-operatively configured such that a gas-enriched reservoir fluid-conducting passage is defined within a space disposed between the pressurized gas-depleted reservoir fluid conductor and the wellbore string; and
the gas-enriched reservoir fluid-conducting passage is disposed in fluid communication with the gas separation zone for conducting the upwardly flowing gas-enriched reservoir fluid from the gas separation zone.

18. The system as claimed in claim 9;
wherein:
the wellbore string is a casing string.

19. The system as claimed in claim 9;
wherein:
the wellbore string passage defines a separation-promoting cross-section, traversed by both of the eccentrically-disposed portion, of the upwardly-conducting gas-depleted reservoir fluid conductor, and the adjacent portion of the gas separation zone.

20. The system as claimed in claim 19;
wherein:
the area of the separation-promoting cross-section of the wellbore string passage, occupied by the adjacent portion of the gas separation zone, includes a circular area traversed by the adjacent portion of the gas separation zone, and the circular area defines at least 70% of the total cross-sectional area of the separation-promoting cross-section of the wellbore string passage.

21. A system comprising a separator, emplaced within a wellbore string passage of a wellbore string that is lining a wellbore through which hydrocarbon material is producible from an oil reservoir within a subterranean formation, wherein:
the separator and the wellbore string are co-operatively configured such that, in response to inducement by a pump:
while reservoir fluid is disposed within a reservoir fluid-receiving zone, disposed within the wellbore string passage, the reservoir fluid is conducted upwardly, via an annular passage disposed between the separator and the wellbore string, from the reservoir fluid-receiving zone to a gas separation zone, disposed within the wellbore string passage, such that the reservoir fluid becomes emplaced within the gas separation zone, with effect that the reservoir fluid flow is separated into at least a downwardly-flowing gas-depleted reservoir fluid and an upwardly flowing gas-enriched reservoir fluid, wherein the separation includes separation in response to buoyancy forces within the gas separation zone; and
while the separated gas-depleted reservoir fluid is flowing downwardly from the gas separation zone, the separator diverts the downwardly-flowing gas-depleted reservoir fluid such that the downwardly-flowing gas-depleted reservoir changes direction and an upwardly-flowing gas-depleted reservoir fluid, being conducted via an upwardly-conducting the gas-depleted reservoir fluid conductor, is established, such that the separator includes the upwardly-conducting gas-depleted reservoir fluid conductor;
wherein:
the gas separation zone defines a downhole completion-free space that is unoccupied by a downhole completion; and
the wellbore string passage defines a separation-promoting cross-section, within which is disposed the downhole completion-free space and which is traversed by the upwardly-conducting gas-depleted reservoir fluid conductor, and the area of the separation-promoting cross-section of the wellbore string passage, occupied by the downhole completion-free space, includes a circular area, and the circular area defines at least 70% of the total cross-sectional area of the cross-section of the wellbore string passage.

22. The system as claimed in claim 21;
wherein:
the circular area of the separation-promoting cross-section of the wellbore string passage, occupied by the gas separation zone, defines at least 80% of the total separation-promoting cross-sectional area of the cross-section of the wellbore string passage.

23. The system as claimed in claim 21;
wherein:
the downhole completion-free spaces includes a cylindrical space, and the cylindrical space has a diameter of at least one (1) inch and a height of at least 12 inches.

24. The system as claimed in claim 21;
wherein:
the separator and the wellbore string are further co-operatively configured such that the separation-promoting cross-section is disposed within a vertical section of the wellbore.

25. The system as claimed in claim 21;
wherein:
the separator defines a flow receiving communicator, such that the receiving of the separated gas-depleted reservoir fluid by the separator is effected by the flow receiving communicator; and
the ratio, of (i) the cross-sectional flow area of separation-promoting cross-section of the wellbore string passage, to (ii) the cross-sectional flow area of the flow receiving communicator, is less than 1.1:1.

26. A system comprising a separator, emplaced within a wellbore string passage of a wellbore string that is lining a wellbore through which hydrocarbon material is producible from an oil reservoir within a subterranean formation, wherein:
the separator and the wellbore string are co-operatively configured such that, in response to inducement by a pump:
while reservoir fluid is disposed within a reservoir fluid-receiving zone, disposed within the wellbore string passage, the reservoir fluid is conducted upwardly, via an annular passage disposed between the separator and the wellbore string, from the reservoir fluid-receiving zone to a gas separation zone, disposed within the wellbore string passage, such that the reservoir fluid becomes emplaced within the gas separation zone, with effect that the reservoir fluid flow is separated into at least a downwardly-flowing gas-depleted reservoir fluid and an upwardly flowing gas-enriched reservoir fluid, wherein the separation includes separation in response to buoyancy forces within the gas separation zone; and
while the separated gas-depleted reservoir fluid is flowing downwardly from the gas separation zone, the separator diverts the downwardly-flowing gas-depleted reservoir fluid such that the downwardly-flowing gas-depleted reservoir changes direction and an upwardly-flowing gas-depleted reservoir fluid, being conducted via an upwardly-conducting gas-depleted reservoir fluid conductor, is established, such that the separator includes the upwardly-conducting gas-depleted reservoir fluid conductor;
wherein:
the gas separation zone defines a downhole completion-free space that is unoccupied by a downhole completion;
and
the upwardly-conducting gas-depleted reservoir fluid conductor includes an eccentrically-disposed portion, disposed eccentrically relative to a central longitudinal axis of the wellbore string, and the eccentrically-disposed portion is disposed laterally relative to an adjacent portion of the downhole completion-free space.

27. The system as claimed in claim 26;
wherein:
the eccentrically-disposed portion is spaced-apart from the wellbore string by less than 0.75 inches.

28. The system as claimed in claim 26;
wherein:
eccentrically disposed portion is spaced-apart from the wellbore string by less than 0.5 inches.

29. The system as claimed in claim 26;
further comprising:
the pump fluidly coupled to the upwardly-conducting gas-depleted fluid conductor; and
a pressurized gas-depleted reservoir fluid conductor for conducting the gas-depleted reservoir fluid, that has been pressurized by the pump, to the surface;
wherein:
the pressurized gas-depleted reservoir fluid conductor and the wellbore string are co-operatively configured such that a gas-enriched reservoir fluid-conducting passage is defined within a space disposed between the pressurized gas-depleted reservoir fluid conductor and the wellbore string; and
the gas-enriched reservoir fluid-conducting passage is disposed in fluid communication with the gas separation zone for conducting the upwardly flowing gas-enriched reservoir fluid from the gas separation zone.

30. The system as claimed in claim 26;
wherein:
the gas separation zone is disposed within a vertical section of the wellbore.

31. The system as claimed in claim 26;
wherein:
the separator defines a flow receiving communicator, such that the receiving of the downwardly-flowing gas-depleted reservoir fluid by the separator is effected by the flow receiving communicator; and
the ratio, of (i) the cross-sectional flow area of a traversed portion of the wellbore string passage, that is traversed by the adjacent portion of the downhole completion-free zone, to (ii) the cross-sectional flow area of the flow receiving communicator, is less than 1.1:1.

32. The system as claimed in claim 26;
wherein:
the wellbore string passage defines a separation-promoting cross-section, traversed by both of the eccentrically-disposed portion, of the upwardly-conducting gas-depleted reservoir fluid conductor, and the adjacent portion of the downhole completion-free space.

33. The system as claimed in claim 32;
wherein:
the area of the separation-promoting cross-section of the wellbore string passage, occupied by the downhole completion-free space, includes a circular area, and the circular area defines at least 70% of the total cross-sectional area of the cross-section of the wellbore string passage.

* * * * *